US007220073B2

(12) United States Patent
Yoon

(10) Patent No.: US 7,220,073 B2
(45) Date of Patent: May 22, 2007

(54) SLIDE-TYPE WRITING INSTRUMENT WITH A DRY PREVENTION UNIT

(75) Inventor: Hyun-son Yoon, Seoul (KR)

(73) Assignee: Morris Corporation, Inchon-shi (KR)

( * ) Notice: Subject to any disclaimer, the term of this patent is extended or adjusted under 35 U.S.C. 154(b) by 353 days.

(21) Appl. No.: 10/887,999

(22) Filed: Jul. 9, 2004

(65) Prior Publication Data

US 2005/0191112 A1 Sep. 1, 2005

(30) Foreign Application Priority Data

Feb. 26, 2004 (KR) ..... 10-2004-0012867
May 3, 2004 (KR) ..... 10-2004-0031012

(51) Int. Cl.
*B43K 5/16* (2006.01)

(52) U.S. Cl. ..... 401/108; 401/107

(58) Field of Classification Search ..... 401/99, 401/107, 108

See application file for complete search history.

(56) References Cited

U.S. PATENT DOCUMENTS 1,923,634 A * 8/1933 Markstein ..... 401/108
2,590,943 A * 4/1952 Coskey et al. ..... 401/116
4,629,348 A * 12/1986 Hashimoto et al. ..... 401/107
6,371,129 B1 * 4/2002 Le Bras-Brown et al. .. 132/218

* cited by examiner

*Primary Examiner*—David J. Walczak
(74) *Attorney, Agent, or Firm*—Intellectual Property Law Group LLP; Otto O. Lee; Juneko Jackson

(57) ABSTRACT

A slide-type writing instrument with a dry prevention unit which allows a nib to be extended and exposed to an outside through a non-contact extension operation while sealing a portion around the nib, prevents ink of the nib from being dried up without using any cap, and safely protects the nib. A slide-type writing instrument with a dry prevention unit comprises a shaft to provide a body of the writing instrument, with a nib hole provided at a lower end of the shaft; a knock part inserted into an insert hole provided at an upper end of the shaft; a cartridge inserted into the shaft while being coupled at opposite ends thereof to the knock part and a nib, respectively; first and second springs coupled to the cartridge to elastically bias the cartridge in an axial direction of the cartridge; a link holder provided in the shaft and supported by the first spring; a link slidably inserted into the link holder and supported by the second spring, the link including a link projeciion to engage with a guide groove provided on a predetermined portion of the cartridge; and a spherical door having a pin slit to engage with a parallel pin of the link.

4 Claims, 46 Drawing Sheets

SLIDE-TYPE WRITING INSTRUMENT WITH A DRY PREVENTION UNIT

BACKGROUND OF THE INVENTION

1. Field of the Invention

The present invention relates generally to writing instruments, and more particularly to a slide-type writing instrument with a dry prevention unit, which is constructed so that a nib which dispenses ink supplied from a cartridge is projected out only when the writing instrument is in use, and the nib is retracted into a body of the writing instrument to be sealed in the body when the writing instrument is not in use.

2. Description of the Related Art

Generally, writing instruments are typically classified into fixed-type writing instruments, rotary-type writing instruments, knock-type writing instruments, and slide-type writing instruments. The fixed-type writing instruments are designed so that a cartridge is fixed in a shaft and a cap is used to cover a nib. The rotary-type writing instruments are designed so that a part of a shaft rotates to make a part of a cartridge be projected out. The knock-type writing instruments are designed so that a cartridge is projected out by a spring when a part of a shaft is pressed. Further, the slide-type writing instruments are designed so that a cartridge slides to be retracted into and projected out of a shaft.

The slide-type writing instruments have an advantage in that it is unnecessary to open or close an additional cap. However, the slide-type writing instruments have a problem in that a nib hole is formed on an end of the writing instrument, so that such a slide-type structure may be limitedly applied to only non-volatile writing instruments, such as oil-based ink.

Thus, writing instruments having high volatility, for example, a marker pen, a correction pen, a roller ball pen, a highlight pen, etc., must have caps, although it is inconvenient to open or close the caps. The reason why the writing instruments having high volatility have the caps is that ink of the nibs is dried up when the nibs of the writing instruments are exposed to the air, thus shortening the life spans of the writing instruments.

In order to solve the problems, there have been efforts to develop a writing instrument which prevents ink of the writing instrument using liquid or semi-liquid ink, or volatile or non-volatile ink from being dried up, while protecting a nib of the writing instrument.

In Japanese Patent No. 1987-0012570, there is proposed a writing instrument titled 'capless writing instrument with dry prevention unit'. The writing instrument disclosed in the document has a slide-type structure, and prevents a nib from being dried up while protecting the nib. When a user presses a push-button of the writing instrument once, a cover is opened to open a nib hole by a tensile force of an elastic cord. Further, when the user presses the push-button once more, the cover is closed, thus preventing ink from being dried up.

However, the writing instrument according to Japanese Patent No. 1987-0012570 has problems in that it uses the tensile force of the elastic cord, so that the opening or closing of the cover is not rapidly executed, and it has low durability, and further, a sealing effect of the cover to temporarily close a nib hole is very poor.

Furthermore, there is a proposed writing instrument in Korean U.M. Registration No. 172486, registered in 1999 and titled 'slide-type writing instrument with a tip protective unit'. According to Korean U.M. Registration No. 172486, the writing instrument is provided with the tip protective unit to prevent a nib from being dried up. In this case, the tip protective unit seals the tip of the nib while the products are transported and marketed, thus preventing ink from being dried up.

However, the writing instrument according to Korean U.M. Registration No. 172486 has a problem in that the tip protective unit must be discarded during the use of the writing instrument, so that the writing instrument loses a dry prevention function. Further, the writing instrument may be limitedly applied to a ball-point pen.

Furthermore from Korean U.M. Registration No. 174279, which was registered in 1999, there is a known nib dry prevention unit. According to Korean U.M. Registration No. 174279, when a push-button of a slide-type writing instrument is pressed, the nib passes through a cut slit of a rubber packing to be exposed to the atmosphere, so that a user can write with the writing instrument. Meanwhile, when the push-button is released or is pressed once more, the nib returns to an original position thereof, and the cut slit is closed by elasticity of the rubber packing, thus preventing ink from being dried up.

However, the writing instrument according to Korean U.M. Registration No. 174279 has a problem in that plastic deformation of the cut slit may occur due to frequent use of the writing instrument. The writing instrument has another problem in that it is difficult to seal the push-button, which executes a sliding motion, so that sealing efficiency is low.

In Korean Patent Application No. 10-2000-65693 there is a proposed 'writing instrument with inseparable elastic cap'. According to Korean Patent Appln. No. 10-2000-65693, the writing instrument is provided with an elastic cap. The elastic cap has, at a predetermined position thereof, a cut slit through which a nib passes. Further, a predetermined portion of the elastic cap, which is opposite to the cut slit, is in close contact with a guide groove of the writing instrument. Thus, when the cap moves backward, the nib is exposed to an outside so that a user writes with the instrument. Conversely, when the cap moves forward, the cap prevents the drying of ink. A middle portion of the writing instrument has the same shape as a body of a usual writing instrument.

However, the writing instrument according to Korean Patent Appln. No. 10-2000-65693 has a problem in that a portion around the cut slit may be stained with ink, because the nib is exposed to the outside through the cut slit. Further, since the cut slit is closed by a subsidiary unit, such as a rubber ring which may be easily elastically deformed, the nib is in direct contact with the cut slit and thereby is broken or damaged, and durability of the writing instrument is relatively low. The writing instrument is problematic in that the rubber ring is exposed to the outside of the cut slit, so that the rubber ring may be damaged when the rubber ring is in contact with an external object. Further, the cut slit may, be deformed due to frequent use of the writing instrument, so that efficiency of sealing the nib may be deteriorated.

SUMMARY OF THE INVENTION

Accordingly, the present invention has been made keeping in mind the above problems occurring in the prior art, and an object of the present invention is to provide a slide-type writing instrument having a dry prevention unit which is rapidly opened or closed in a direct transmission manner and is convenient to use, thus allowing an end of a cartridge, that is, a nib to be extended and exposed to an outside through a non-contact extension operation, while sealing a portion around the nib. Further, the slide-type writing instrument with the dry prevention unit prevents ink of the nib from being dried up without using any cap, and safely protects the nib.

Another object of the present invention is to provide a slide-type writing instrument with a dry prevention unit, in which an O-ring allows for a sliding motion of a nib extension part and accomplishes a sealing effect without the necessity of forming any slit on the nib extension part, thus having excellent sealing capacity.

In order to accomplish the above object, the present invention provides a slide-type writing instrument with a dry prevention unit, including a shaft to provide a body of the writing instrument, with a nib hole provided at a lower end of the shaft; a knock part inserted into an insert hole provided at an upper end of the shaft; a cartridge inserted into the shaft while being coupled at opposite ends thereof to the knock part and a nib, respectively; first and second springs coupled to the cartridge to elastically bias the cartridge in an axial direction of the cartridge; a link holder provided in the shaft and supported by the first spring; a link slidably inserted into the link holder and supported by the second spring, the link including a link projection to engage with a guide groove provided on a predetermined portion of the cartridge; and a spherical door having a pin slit to engage with a parallel pin of the link.

Further, in order to accomplish the above object, the present invention provides a slide-type writing instrument with a dry prevention unit, including a knock part to control a nib so that the nib is projected out of or retracted into a nib hole provided at an end of a shaft; a cartridge inserted into the shaft while being coupled at opposite ends thereof to the knock part and the nib, respectively; a spring provided in the shaft to elastically restore the cartridge to an original position thereof; an O-ring provided in the shaft to be supported by the spring; a link holder partially inserted into the O-ring; a link slidably coupled to the link holder, and having a plurality of elastic pieces to engage with a clutch part of the cartridge within an elastic range of the elastic pieces; and a spherical door having a pin slit to engage with a parallel pin of the link.

Furthermore, in order to accomplish the above object, the present invention provides a slide-type writing instrument with a dry prevention unit, including a knock part to control a nib so that the nib is projected out of or retracted into a nib hole provided at an end of a shaft; a cartridge inserted into the shaft while being coupled at opposite ends thereof to the knock part and the nib, respectively; a first spring provided in the shaft to elastically restore the cartridge to an original position thereof; an O-ring provided in the shaft to be supported by the first spring; a link holder provided in the shaft while an end of the link holder being axially inserted into the O-ring; a link supported in the link holder by a second spring, and having a plurality of elastic pieces to engage with a clutch part of the cartridge; and a spherical door having a pin slit to engage with a parallel pin of the link.

BRIEF DESCRIPTION OF THE DRAWINGS

The above and other objects, features and other advantages of the present invention will be more clearly understood from the following detailed description taken in conjunction with the accompanying drawings, in which:

FIGS. 3*a* and 3*b* show a shaft to provide a body of the writing instrument of FIG. 2, in which FIG. 3*a* is a front view of the shaft and FIG. 3*b* is a sectional view taken along the line A—A of FIG. 3*a;*

FIGS. 4*a* and 4*b* show a knock part included in the writing instrument of FIG. 2, in which FIG. 4*a* is a front view of the knock part and FIG. 4*b* is a sectional view taken along the line B—B of FIG. 4*a;*

FIGS. 5*a* through 5*d* show a cartridge to provide an ink reservoir of the writing instrument of FIG. 2, in which FIG. 5*a* is a front view of the cartridge, and FIGS. 5*b,* 5*c,* and 5*d* are sectional views taken along the lines C—C, D—D, and E—E of FIG. 5*a,* respectively;

FIGS. 6*b* through 6*d* show the link holder of FIG. 6*a,* in which FIGS. 6*b* and 6*c* are a front view and a left side view of the link holder of FIG. 6*a,* respectively, and FIG. 6*d* is a sectional view taken along the line F—F of FIG. 6*c;*

FIGS. 7*b* and 7*c* show the link of FIG. 7*a,* in which FIG. 7*b* is a side view of the link and FIG. 7*c* is a sectional view taken along the line G—G of FIG. 7*b;*

FIGS. 7*d* and 7*e* show the link of FIG. 7*a,* in which FIG. 7*d* is a plan view of the link and FIG. 7*e* is a sectional view taken along the line H—H of FIG. 7*d;*

FIGS. 8*b* and 8*c* show the spherical door of FIG. 8*a,* in which FIG. 8*b* is a side view of the door and FIG. 8*c* is a sectional view taken along the line I—I of FIG. 8*b;*

FIGS. 8*d* through 8*f* show the spherical door of FIG. 8*a,* in which FIG. 8*d* is a plan view of the door and FIGS. 8*e* and 8*f* are sectional views taken along the line J—J and K—K of FIG. 8*d,* respectively;

FIGS. 9*a* and 9*b* show the writing instrument of FIG. 1*a,* in which FIG. 9*a* is a side view of the writing instrument and FIG. 9*b* is a sectional view taken along the line L—L of FIG. 9*a* to illustrate an assembled state of the writing instrument;

FIG. 20*b* is a sectional view taken along the line S—S of FIG. 20*a,* FIG. 20*d* is a sectional view taken along the line T—T of FIG. 20*c, * and FIG. 20*f* is a sectional view taken along the line U—U of FIG. 20*e.*

DESCRIPTION OF THE PREFERRED EMBODIMENTS

Figure 1A:
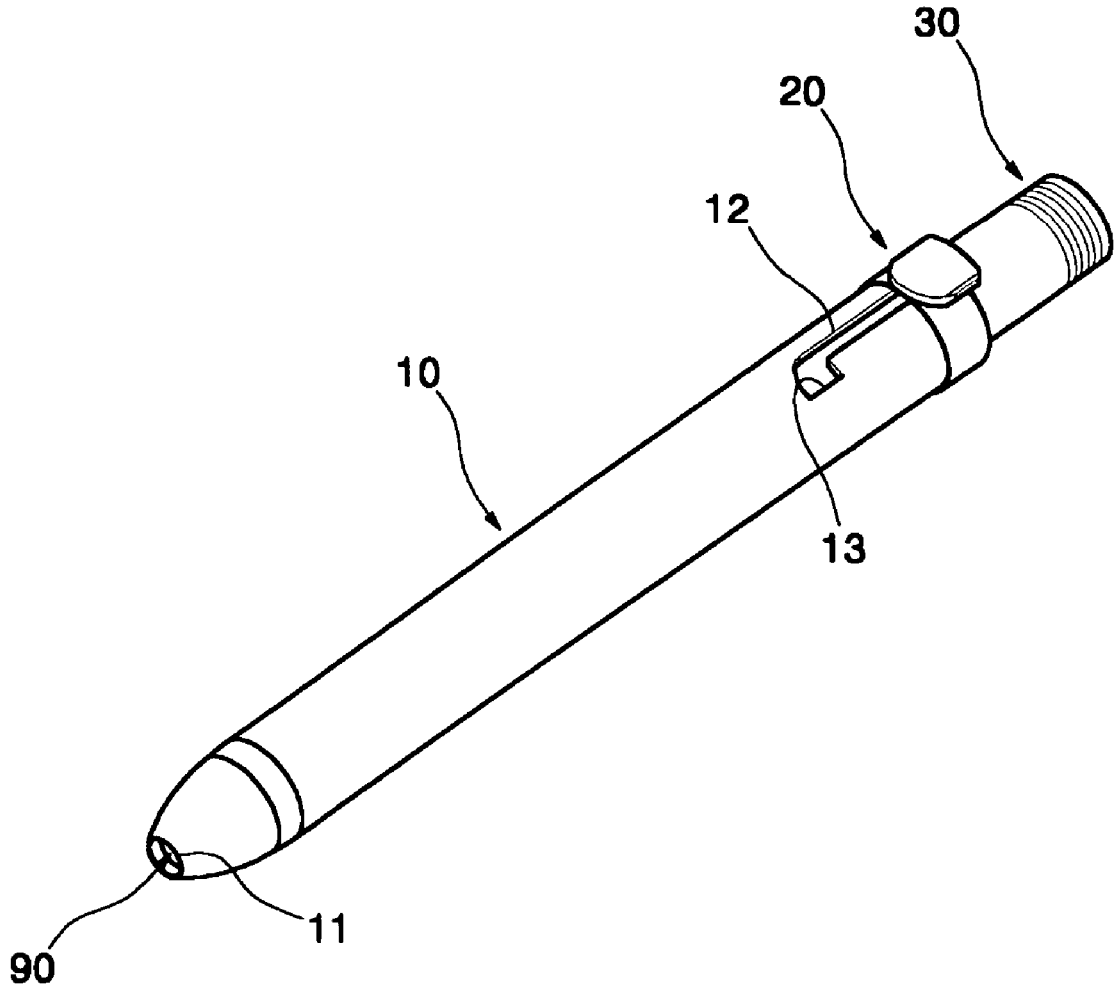
FIGS. 1*a* and 1*b* are perspective views to show an exterior of a slide-type writing instrument with a dry prevention unit, according to a first embodiment of the present invention.

Hereinafter, embodiments of the present invention will be described in detail with reference to the attached drawings.

Reference now should be made to the drawings, in which the same reference numerals are used throughout the different drawings to designate the same or similar components.

<First Embodiment>

Figure 1B:
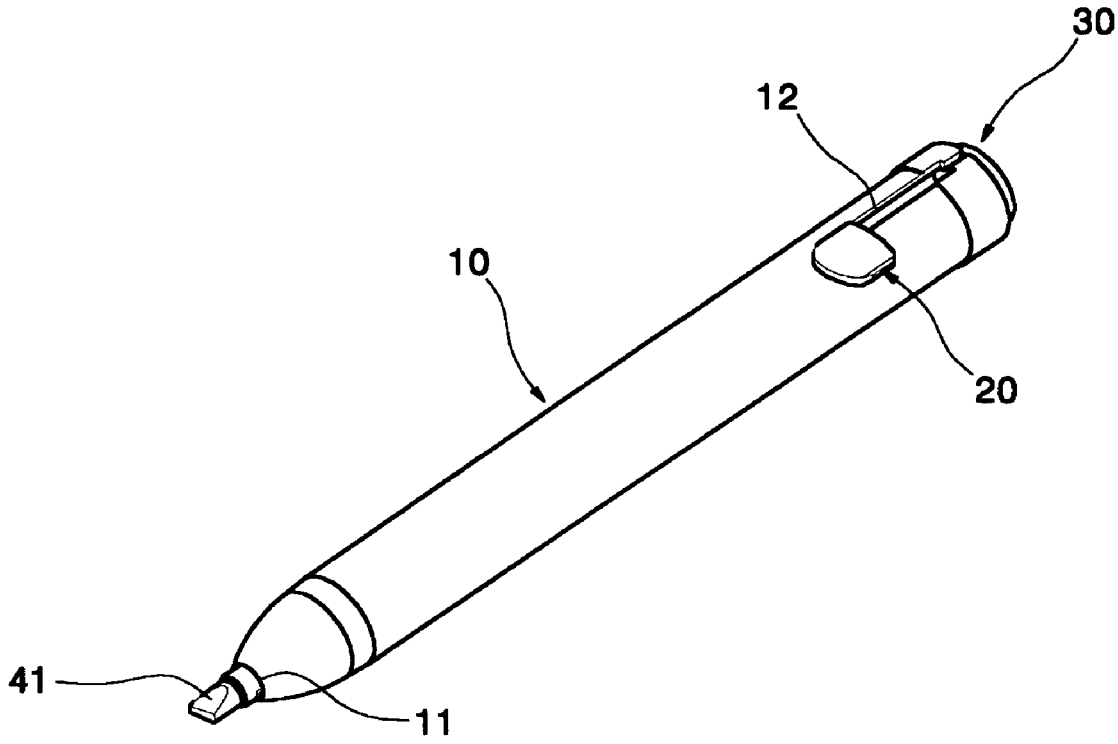

FIGS. 1*a* and 1*b* show a writing instrument, according to a first embodiment of the present invention.

The writing instrument includes a shaft 10, which provides a single body or a body divided into two parts. A dry prevention unit operated in a direct transmission manner is installed in the shaft 10.

According to the present invention, the dry prevention unit means a unit that is operated in a direct transmission manner to selectively open or close a spherical door 90. That is, when the writing instrument is not in use, the spherical door 90 closes a nib hole 11 of the shaft 10. However, when a user manipulates a switch 20, a force is applied to the knock part 30 and directly transmitted to the spherical door 90, thus opening the spherical door 90.

The nib hole 11 is formed at a cone-shaped lower end of the shaft 10, while the knock part 30 is coupled to an upper end of the shaft 10.

That is, the user holds the shaft 10 of the writing instrument by one hand, and then presses the knock part 30 provided at an upper end of the writing instrument, corresponding to a pressing part, by the user's thumb. Subsequently, the switch 20 is rotated by a predetermined rotating angle to be stopped by a stepped slot 13 which is provided at an inside end of a shaft guide slit 12.

Meanwhile, when the user presses the knock part 30, the spherical door 90 operated in conjunction with a cartridge 40 having the knock part 30 rotates at a rotating angle of +90° in an opening direction so that a passage of the spherical door 90 is aligned with a nib 41 to open the nib hole 11 of the shaft 10.

Thereafter, the nib 41 is projected out of the nib hole 11 through the passage of the spherical door 90, so that the user can write with the writing instrument.

Conversely, when the user rotates the switch 20 by a predetermined rotating angle in a reverse direction, the switch 20 is removed from the stepped slot 13 of the shaft guide slit 12. Further, the nib 41 returns to an original position thereof, that is, is retracted into the shaft 10, by first and second springs 60 and 65 provided in the shaft 10.

Subsequently, the spherical door 90 rotates at a rotating angle of −90° in a closing direction by the first and second springs 60 and 65 so that the passage of the spherical door 90 is perpendicular to the nib 41, and simultaneously, the nib hole 11 of the shaft 10 is closed.

The writing instrument according to the present invention will be described in the following with reference to FIG. 2, and FIGS. 3 through 8*g*. In this case, FIG. 2 is an exploded perspective view to show internal elements of the writing instrument of this invention, and FIGS. 3 through 8*g* show the internal parts in detail.

The dry prevention unit of this invention means a unit that opens or closes the nib hole 11 of the shaft 10 which will be described in the following in detail. Further, several parts, including the switch 20, the knock part 30, the cartridge 40, an O-ring 50, the first and 'second springs 60 and 65, a link holder 70, a link 80, and the spherical door 90, are organically assembled with the shaft 10, and the constructions and operations of the above-mentioned parts will be described in the following.

Figure 2:
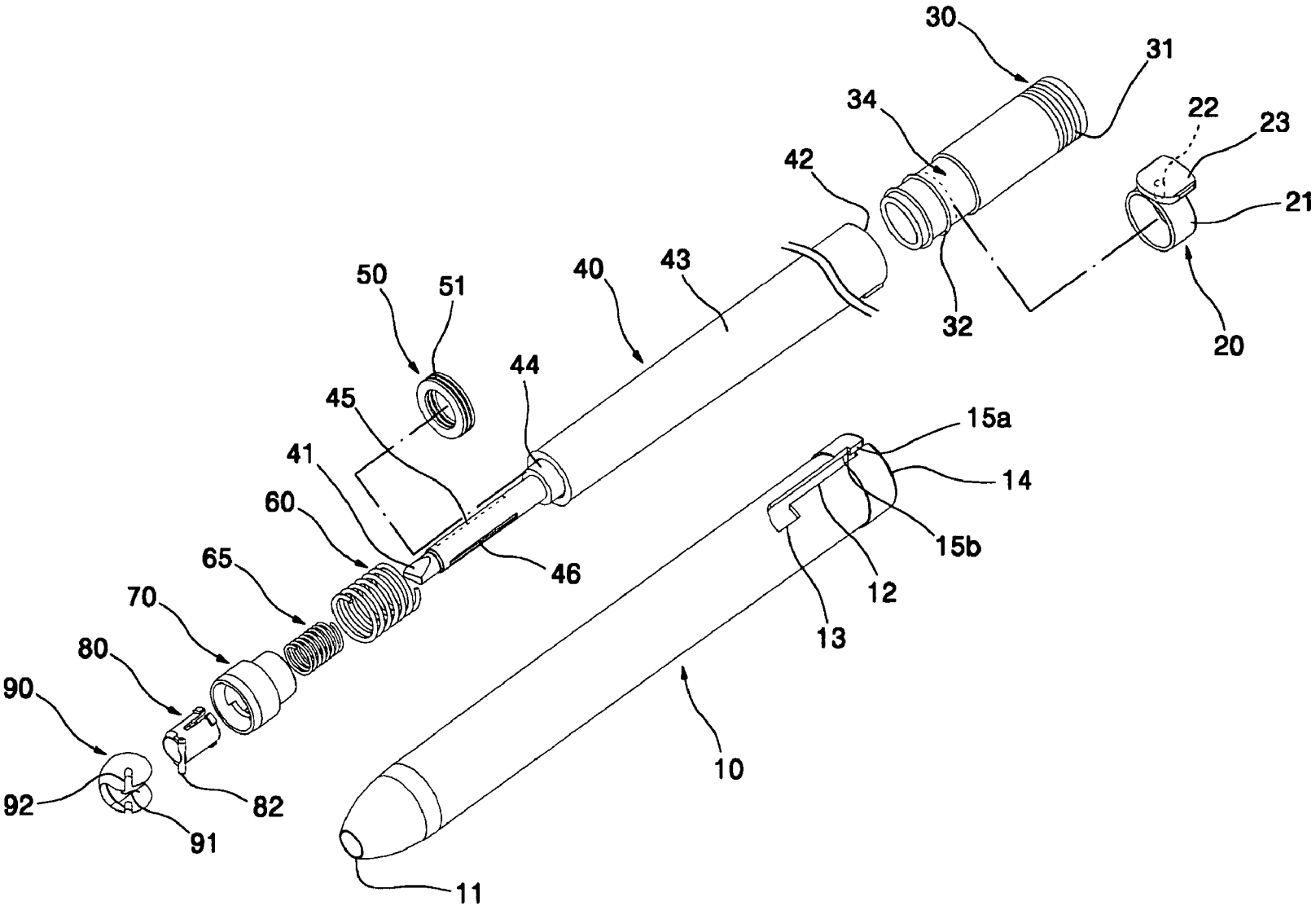
FIG. 2 is an exploded perspective view to show an interior of the writing instrument of FIG. 1*a;*
Figure 3A:
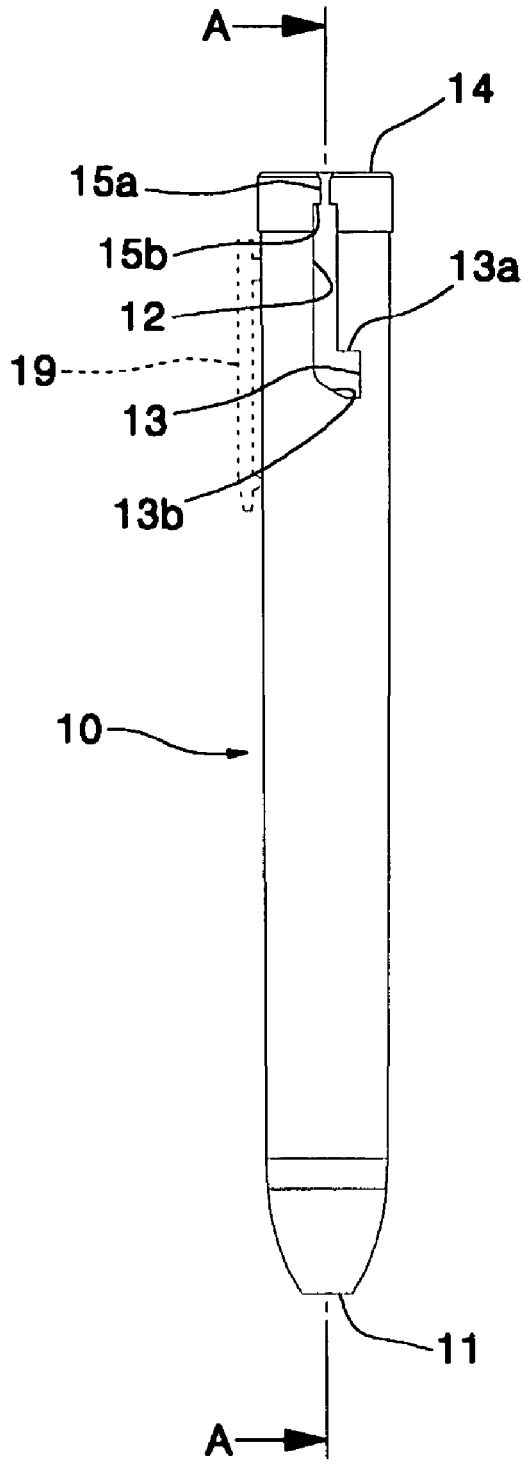
Figure 3B:
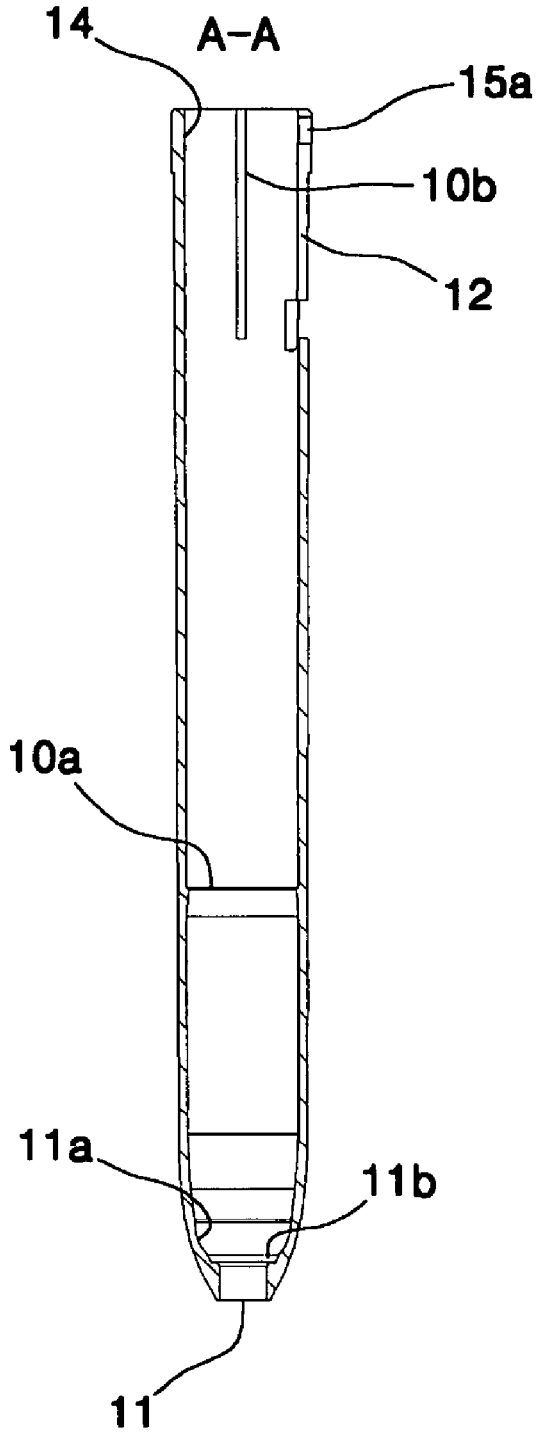

Referring to FIGS. 2, 3*a* and 3*b,* the shaft 10 to provide the body of the writing instrument has a shape of a hollow pipe or tube.

The shaft 10 is made of plastics and manufactured through an injection molding process or a molding process.

Further, the shaft 10 has general characteristics of plastics, namely, elasticity or flexibility.

The nib hole 11 is formed at the cone-shaped lower end of the shaft 10, while an insert hole 14 is formed at the upper end of the shaft 10 and has an inner diameter sufficient to accommodate the knock part 30 and the parts which will be described later. The knock part 30 is inserted into the insert hole 14.

As described above, the shaft guide slit 12 and the stepped slot 13 are provided on predetermined portions of the shaft 10 in a thickness direction of the shaft 10, to form a hook shape.

The stepped slot 13 includes a stop edge 13*a,* which acts as a stopper, and an inclined side 13*b,* which allows a smooth sliding motion of the switch 20.

Preferably, a locking slit 15*a* is formed along a longitudinal direction of the shaft guide slit 12. The locking slit 15*a* is provided at an edge of the insert hole 14. Preferably, a mouth of the locking slit 15*a* is enlarged, thus allowing a coupling shaft 22 of the switch 20 to be smoothly coupled to the mouth. Further, in order to prevent unexpected removal of the coupling shaft 22, a plurality of right-angled steps 15*b* are provided at junctions between the locking slit 15*a* and the shaft guide slit 12. In this case, a width of the locking slit 15*a* is narrower than a width of the shaft guide slit 12.

Due to the shaft guide slit 12 and the locking slit 15*a* having such constructions, the insert hole 14 can be slightly enlarged in a circumferential direction thereof. Further, the plurality of right-angled steps 15*b* can restrain the switch 20 so that the switch 20 is not easily removed from the shaft guide slit 12.

In a detailed description, since a portion around the locking slit 15*a* is made of plastics, the switch 20 is easily fitted into the shaft guide slit 12 through the locking slit 15*a* which can be deformed within a predetermined elastic limit, and further, the locking slit 15*a* is elastically restored to an original shape thereof after the fitting of the switch 20 is completed.

Further, a rounded part 11*a* is provided in the cone-shaped lower end of the shaft 10. The rounded part 11*a* allows the spherical door 90 coupled to the rounded part 11*a* to smoothly rotate, in addition to providing a stable support surface for the spherical door 90. Preferably, a lubricant, such as grease, is very thinly coated on a surface of the rounded part 11*a.* Further, at least one annular door seat 11*b* is provided between the rounded part 11*a* and the nib hole 11*e.* In this case, the door seat 11*b* is in line contact with a surface of the spherical door 90, thus sealing an interior of the shaft 10, preventing foreign materials from entering the shaft 10, and allowing the spherical door 90 to smoothly rotate.

In order to seal the interior of the shaft 10, an annular projection 10*a* is provided on a predetermined portion of an inner circumference of the shaft 10 to be slightly projected toward a center of the shaft 10, and has a diameter that is slightly smaller than an inner diameter of a main portion of the shaft 10. The thickness of the annular projection 10*a* depends on a thickness of the O-ring 50. That is, at a first stroke start position where the nib hole 11 of the shaft 10 is closed by the spherical door 90, the O-ring 50 is in close contact with the annular projection 10*a*, thus sealing an interior of the shaft 10 between the nib hole 11 and the O-ring 50.

Further, a straight-shaped shaft sliding groove 10*b* axially extends from an edge of the insert hole 14 of the shaft 10 to a predetermined position. The shaft sliding groove 10*b* guides a rectilinear movement of the cartridge 40 in a direction of the slit 12, in addition to preventing the rotation of the cartridge 40.

Preferably, the shaft 10 further includes a clip 19 which is shown in dotted lines in FIG. 3*a*. The clip 19 is used to hold the writing instrument in a desired place, such as a pocket, to allow a user to easily carry the writing instrument.

As shown in FIG. 2, the switch 20 functions to control the projection and retraction of the writing instrument.

The switch 20 has a ring 21 fitted over a smaller diameter part of the knock part 30. Preferably, the ring 21 of the switch 20 has an inner diameter which allows the ring 21 to be rotatably fitted over the smaller diameter part of the knock part 30, and an outer diameter which allows the ring 21 to be rotatably fitted into the insert hole 14 of the shaft 10.

The switch 20 also includes the coupling shaft 22. The coupling shaft 22 is integrally projected from a surface of the ring 21 to have a predetermined height, for example, a height which is slightly greater than the thickness of a wall of the shaft 10. Preferably, the coupling shaft 22 has a thickness which allows the coupling shaft 22 to freely slide along the shaft guide slit 12.

Further, the switch 20 has a tap 23, which is integrally provided at an upper end of the coupling shaft 22 and has a predetermined area. In this case, the tap 23 serves as a contact surface to allow a user to easily manipulate the switch 20. The shape of the tap 23 may be selected out of a flat shape, a hemispherical shape, and a shape with a non-skid projection.

Figure 4A:
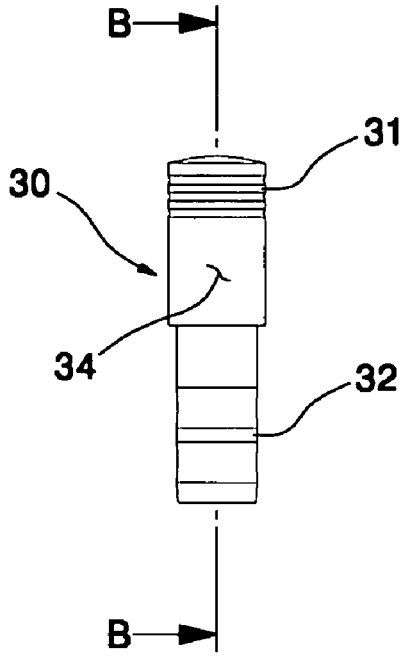
Figure 4B:
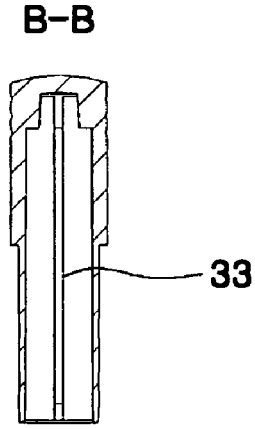

FIG. 4*a* is a front view of the knock part 30 of FIG. 2, and FIG. 4*b* is a sectional view taken along the line B—B of FIG. 4*a*.

Referring to FIGS. 2, 4*a* and 4*b*, the knock part 30 functions to transmit a pressing force of a user to the cartridge 40. Such a knock part 30 has a shape of a tube which includes the smaller diameter part and the larger diameter part to form a step. An end of the smaller diameter part is opened, while an end of the larger diameter part, which is opposite to the end of the smaller diameter part, is closed.

A plurality of uneven grooves 31 are provided on an outer circumferential surface of the larger diameter part of the knock part 30, thus allowing a user to easily grip the knock part 30. Further, a land 34 is provided on an outer circumferential surface of the smaller diameter part of the knock part 30 to allow the ring 21 of the switch 20 to be rotatably coupled to the knock part 30. A plurality of non-skid projections 32 are provided between the land 34 and the end of the smaller diameter part of the knock part 30.

When the smaller diameter part of the knock part 30 is inserted into a cartridge hole 42, the non-skid projections 32 of the knock part 30 are fitted into the cartridge hole 42 through a force-fit method, thus preventing the knock part 30 from being easily removed from the cartridge hole 42.

Preferably, a plurality of ribs 33 are axially arranged on an inner surface of the knock part 30 to reinforce the knock part 30.

Figure 5A:
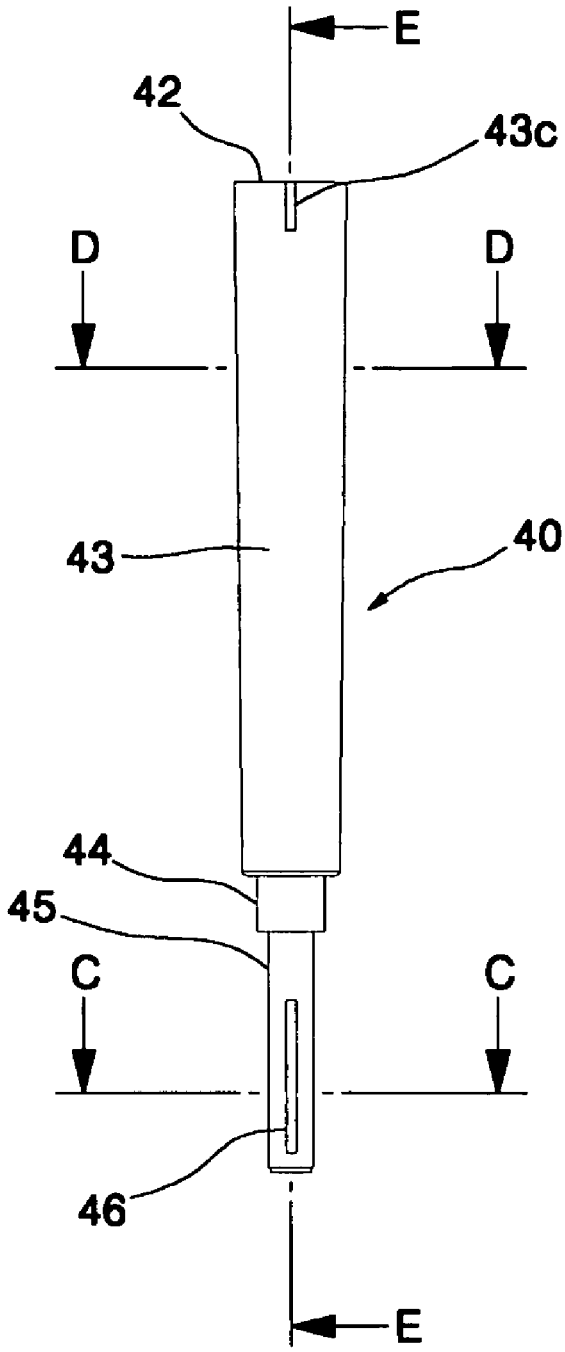
Figure 5B:
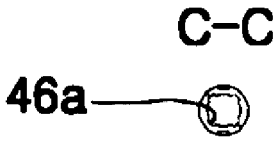
Figure 5C:
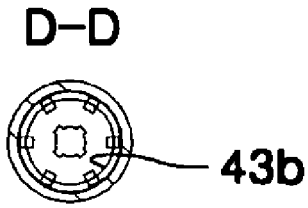
Figure 5D:
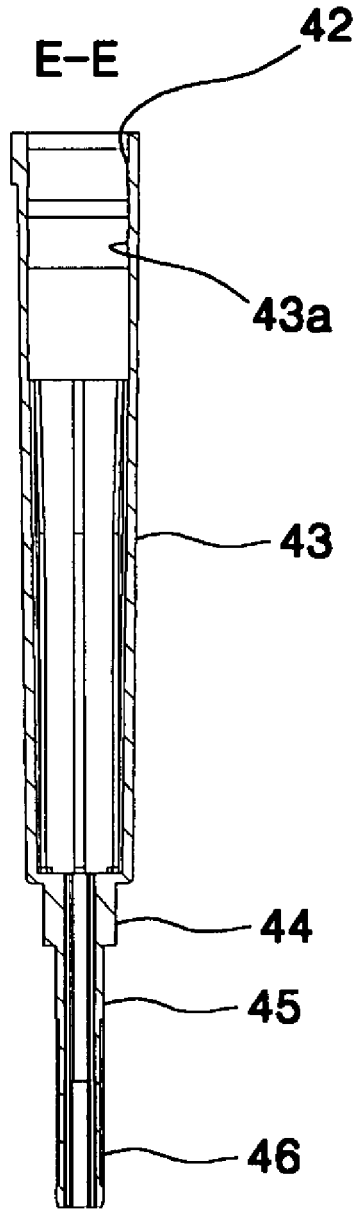

FIG. 5*a* is a front view of the cartridge 40 of FIG. 2, and FIGS. 5*b*, 5*c*, and 5*d* are sectional views taken along the lines C—C, D—D, and E—E of FIG. 5*a*, respectively.

Referring to FIGS. 2, and 5*a* through 5*d*, the cartridge 40 acts as an ink reservoir, and has a predetermined internal capacity.

The cartridge 40 has a shape of a hollow shaft with a surface tapered at a predetermined angle, for example, about 1~5°. The cartridge 40 is opened at opposite ends thereof, and steps are formed on predetermined positions of the cartridge 40.

That is, the cartridge 40 is formed to gradually reduce a diameter thereof in a direction from the cartridge hole 42 to the nib 41 while forming the steps. The cartridge 40 includes a tank part 43, a coupling part 44, and a nib extension part 45 that are integrated into a single structure. In this case, the tank part 43 has the largest diameter. The coupling part 44, having a diameter smaller than the diameter of the tank part 43, is provided under the tank part 43. The nib extension part 45, having a diameter smaller than the diameter of the coupling part 44, is provided under the coupling part 44.

A non-skid ring 43*a* is provided on an upper portion of an inner circumference of the tank part 43, and is coupled to the non-skid projections 32 of the knock part 30 through the force-fit method.

Further, a plurality of support ribs 43*b* are provided on a middle portion of the inner circumference of the tank part 43 to support an ink tube (not shown) and increase durability of the tank part 43.

A cartridge projection 43*c* is provided on an upper portion of the tank part 43 to slide along the shaft sliding groove 10*b* (see, FIG. 3*b*).

The cartridge projection 43*c* is coupled to the shaft sliding groove 10*b* through a slide coupling method, thus guiding the rectilinear movement of the cartridge 40 in the direction of the slit 12, and preventing the rotation of the cartridge 40.

Although not shown in the drawings, the cartridge projection 43*c* of the cartridge 40 may comprise a plurality of cartridge projections 43*c*, and the shaft sliding groove 10*b* of the shaft 10 may comprise a plurality of shaft sliding grooves 10*b*.

A plurality of ink feeding passages 46*a* are provided on an inner circumference of the nib extension part 45. Further, a plurality of cartridge guide grooves 46 are axially provided on an outer circumference of the nib extension part 45 to be formed at diametrically opposite positions of the nib extension part 45.

Each cartridge guide groove 46 engages with an associated link projection 86 (see, FIGS. 7*a* through 7*f*) provided on an inner circumference of the link 80.

Further, the nib 41 is secured to an end of the nib extension part 45, and contents stored in the tank part 43, such as ink, are fed from the tank part 43 to the nib 41 through a conventional ink feeding method adopted according to a kind of a writing instrument, for example, a feeding method using a capillary action, a feeding method using a pressure difference, a feeding method using a suction, etc.

As the nib 41 is used a tip for oil- or water-based ink, a correction fluid discharge tip, a tip for highlight pens, a tip for marker pens, and others, according to a kind of a writing instrument. It is possible to use a suitable ink feeding method according to the kind of the tip.

As shown in FIG. 2, the O-ring 50 slides along the inner circumference of the shaft 10 together with the cartridge 40, while sealing a gap between the cartridge 40 and the shaft 10. The O-ring 50 is fitted over the coupling part 44 of the cartridge 40, and is made of a material, such as rubber, silicone, and soft plastics. The O-ring 50 has a grooved outer circumference 51 to maximize sealing performance, in addition to reducing friction between the cartridge 40 and the shaft 10 when the cartridge 40 slides.

Further, as shown in FIG. 2, the first spring 60 is fitted over the coupling part 44 of the cartridge 40. The first spring 60 is supported by a side surface of the O-ring 50 which is fitted over the coupling part 44.

In this case, the first spring 60 functions to axially bias either the link holder 70 or the cartridge 40 within a stroke distance of the cartridge 40 during the operation of the writing instrument.

For example, when the cartridge 40 and the knock part 30 move forward by a predetermined stroke distance, the first spring 60 is compressed. At this time, the first spring 60 tends to return from the compressed state to an extended state, thus generating an elastic restoring force.

In the present invention, the stroke distance of the cartridge 40 is equal to either a stroke distance of the knock part 30 or a length of the shaft guide slit 12.

Further, as shown in FIG. 2, the second spring 65 is fitted over the nib extension part 45 of the cartridge 40. The second spring 65 is supported by a stepped junction between the coupling part 44 and the nib extension part 45.

In such a state, the second spring 65 functions to axially bias either the link 80 or the cartridge 40 during the operation of the writing instrument.

For example, when the cartridge 40 and the knock part 30 move forward, the second spring 65 is compressed for a short period. At this time, the second spring 65 biases the link 80, thus allowing the spherical door 90 rotatably coupled to the link 80 to be smoothly and rapidly opened or closed.

Figure 6A:
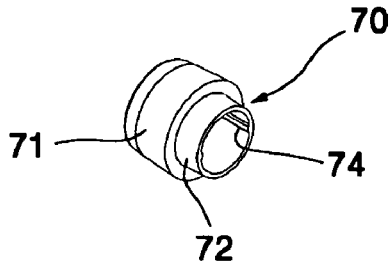
FIG. 6*a* is a perspective view to show a rear part of a link holder included in the writing instrument of FIG. 2.
Figure 6B:
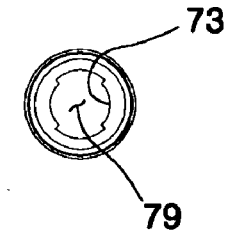
Figure 6C:
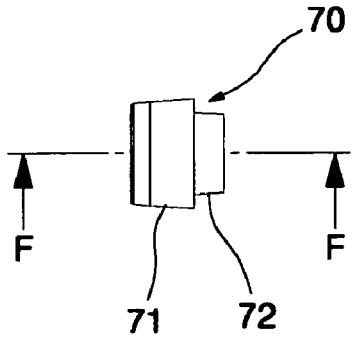
Figure 6D:
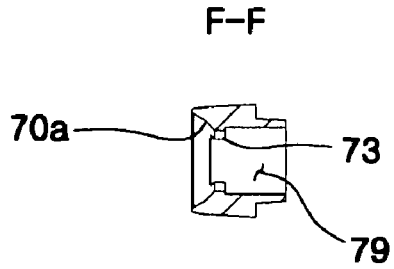
Figure 7A:
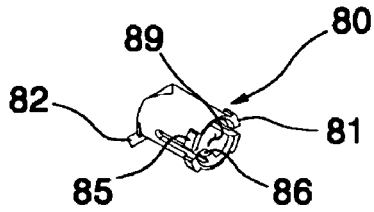
FIG. 7*a* is a perspective view to show a rear part of a link included in the writing instrument of FIG. 2.
Figure 7B:
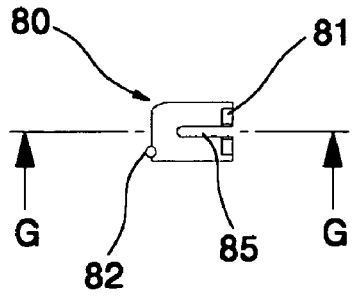
Figure 7C:
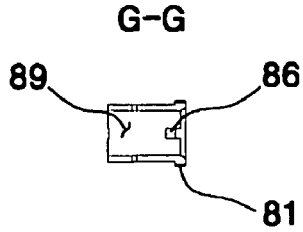
Figure 7D:
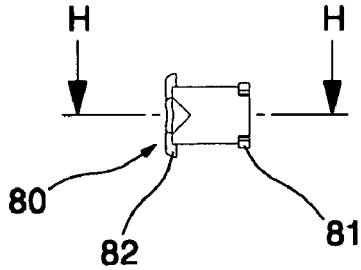
Figure 7E:
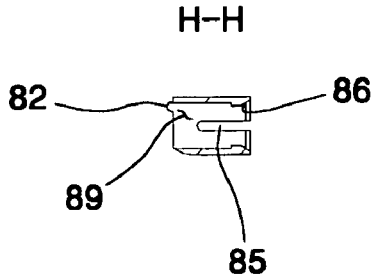
Figure 7F:
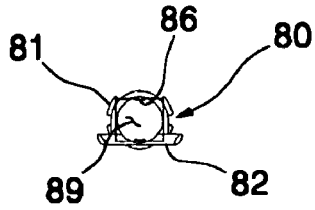
FIG. 7*f* is a front view of the link of FIG. 7*a;*
Figure 8A:
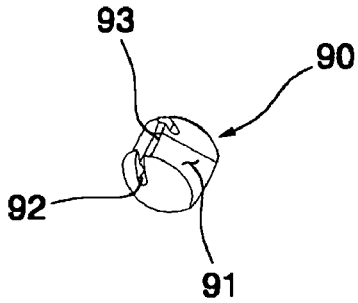
FIG. 8*a* is a perspective view to show an interior of a spherical door included in the writing instrument of FIG. 2.
Figure 8B:
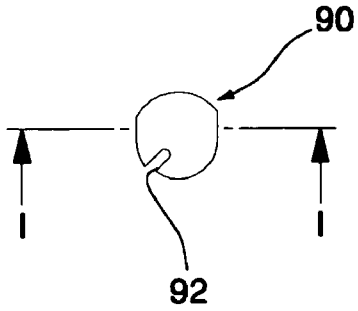
Figure 8C:
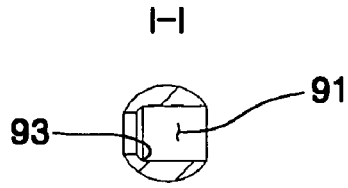
Figure 8D:
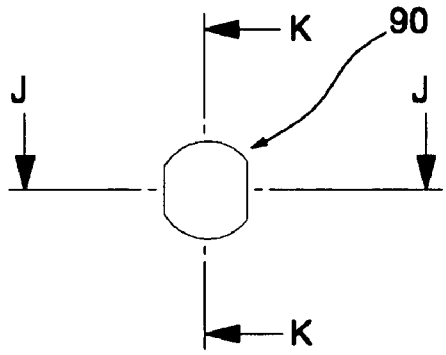
Figure 8E:
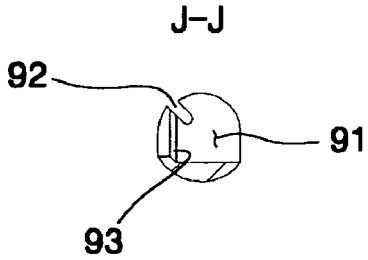
Figure 8F:
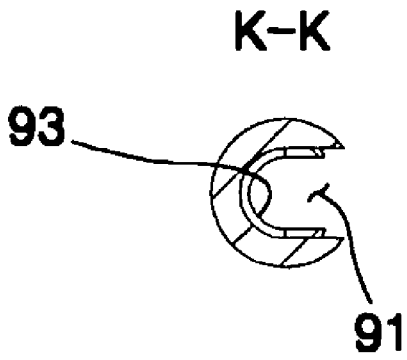
Figure 8G:
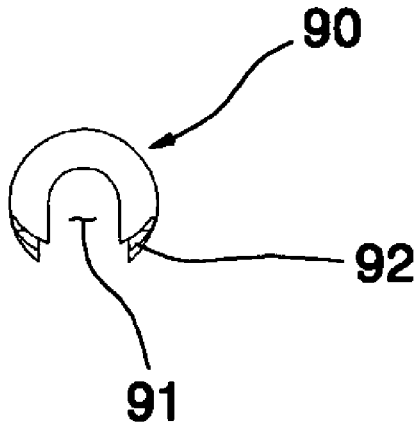
FIG. 8*g* is a front view of the spherical door of FIG. 8*a;*

FIG. 6*a* is a perspective view to show a rear part of the link holder 70 of FIG. 2, and FIGS. 6*b* and 6*c* are a front view and a left side view of the link holder 70 of FIG. 6*a*, respectively, and FIG. 6*d* is a sectional view taken along the line F—F of FIG. 6*c*.

Referring to FIG. 2 and FIGS. 6*a* through 6*d*, the link holder 70 is fitted over the nib extension part 44, and then is elastically supported by the first spring 60, thus allowing the spherical door 90 to be in close contact with the rounded part 11*a* inside the nib hole 11 of the shaft 10.

The link holder 70 has a shape of a hollow bushing which includes a front larger diameter part 71 and a rear smaller diameter part 72. An end of the first spring 60 is fitted over the rear smaller diameter part 72 of the link holder 70. Thus, the first spring 60 is supported by a stepped junction between the front larger diameter part 71 and the rear smaller diameter part 72.

Further, a link mount hole 79 is formed at a center of the link holder 70. A rounded part 70*a* is provided in the front of the link mount hole 79. The rounded part 70*a* of the link holder 70 allows the spherical door 90 seated on the rounded part 70*a* to smoothly rotate, in addition to providing a stable support surface for the spherical door 90. Further, another door seat (not shown) having the same function as the above-mentioned door seat 11*b* may be provided on the rounded part 70*a*.

A stopper step 73 is inwardly projected from an inner circumference around the rounded part 70*a* by a predetermined height, thus forming a ▭-shaped cross-section.

The link 80 is axially inserted into the link mount hole 79 of the link holder 70.

At this time, the shape of the cross-section of the stopper step 73 is similar to the shape ⊗ of the cross-section of a rear portion of the link 80, thus allowing the link 80 to be easily inserted into the link mount hole 79.

When a worker rotates only the link holder 70 by 90° after inserting the link 80 into the link mount hole 79, the stopper step 73 of the link holder 70 rotates so that the cross-section thereof is changed from a ▭-shaped state to a ▯-shaped state. The rear portion of the link 80 maintains the ⊗-shaped state.

In this way, the link 80 can be easily inserted into the link holder 70, and further, the link 80 is stopped by the stopper step 73 of the link holder 70, thus preventing the link 80 from being unexpectedly removed from the link holder 70.

Particularly, a plurality of straight-shaped guide projections 74 are provided in the link mount hole 79 to extend from the stopper step 73 to an edge of the rear smaller diameter part 72, thus minimizing friction between the link mount hole 79 and the link 80, partially supporting the link 80, minimizing the compression of air, and allowing the link 80 to slide along the link holder 70 while the center of the link 80 is aligned with the center of the link holder 70.

FIGS. 7*a* through 7*f* are views to show the shape of the link 80.

Referring to FIG. 2 and FIGS. 7*a* through 7*f*, the link 80 has a shape of a tube. That is, an insert hole 89 is axially formed to pass through the link 80, so that the nib extension part 44 is inserted into the insert hole 89 of the link 80.

The link 80 is inserted into the link holder 70 while being elastically supported by the second spring 65.

Further, fan-shaped wings 81 are provided at diametrically opposite sides of the rear portion of the link 80, thus forming the ⊗-shaped cross-section.

A plurality of elastic slits 85 are provided on the link 80 to forwardly extend from the wings 81 to predetermined positions of the link 80.

The elastic slits 85 minimize a weight of the link 80, attenuate vertical vibration or impact during the operation of the writing instrument, and provide a clearance for the link 80 when the link 80 is elastically deformed.

Further, a parallel pin 82 is provided at a lower end of a front portion of the link 80 to be perpendicular to a central axis of the link 80. In this case, the parallel pin 82 is slightly outwardly projected at opposite ends thereof. The opposite ends of the parallel pin 82 are chamfered to correspond to a rounded part of the spherical door 90.

A plurality of link projections 86 are provided on an inner circumference of a rear portion of the insert hole 89. The link projections 86 slide along the corresponding cartridge guide grooves 46 within a predetermined stroke distance, and serve as a locking unit when outer surfaces of the link projections 86 come into contact with inner surfaces of front portions of the cartridge guide grooves 46. Thus, the link projections 86 allow the link 80 to axially slide along the link holder 70, in addition to serving as a hook.

Further, when the parallel pin 82 is coupled to pin slits 92 of the spherical door 90, the link 80 functions to rotate the spherical door 90 at a rotating angle of ±90° in a direct transmission manner.

FIGS. 8*a* through 8*g* are views to show the shape of the spherical door 90.

Referring to FIG. 2 and FIGS. 8*a* through 8*g*, the spherical door 90 serves as a driven unit of the link 80. As a result, the spherical door 90 acts as a door to open or close the nib hole 11.

For a smooth operation, the door 90 has a roughly spherical shape. Further, a passage 91 is formed to pass through a center of the spherical door 90 while being opened at both sides of an outer circumference of the spherical door 90.

The plurality of pin slits 92 are provided at eccentric positions of the spherical door 90 to receive the parallel pin 82 of the link 80.

In this case, the pin slits 92 are formed at opposite sides of the passage 91 to be inclined at a predetermined angle.

The pin slits 92, formed to be inclined at the eccentric positions of the spherical door 90, receive the parallel pin 82, thus functioning as a cam slit. That is, the pin slits 92 receiving the parallel pin 82 convert a link sliding force into a rotating force, which rotates the spherical door 90 within a predetermined angular range.

Further, a step 93 is provided on an inner circumference of a front portion of the passage 91, thus limiting a stroke of the link 80.

The assembly of the above-mentioned elements will be described in the following.

Figure 9A:
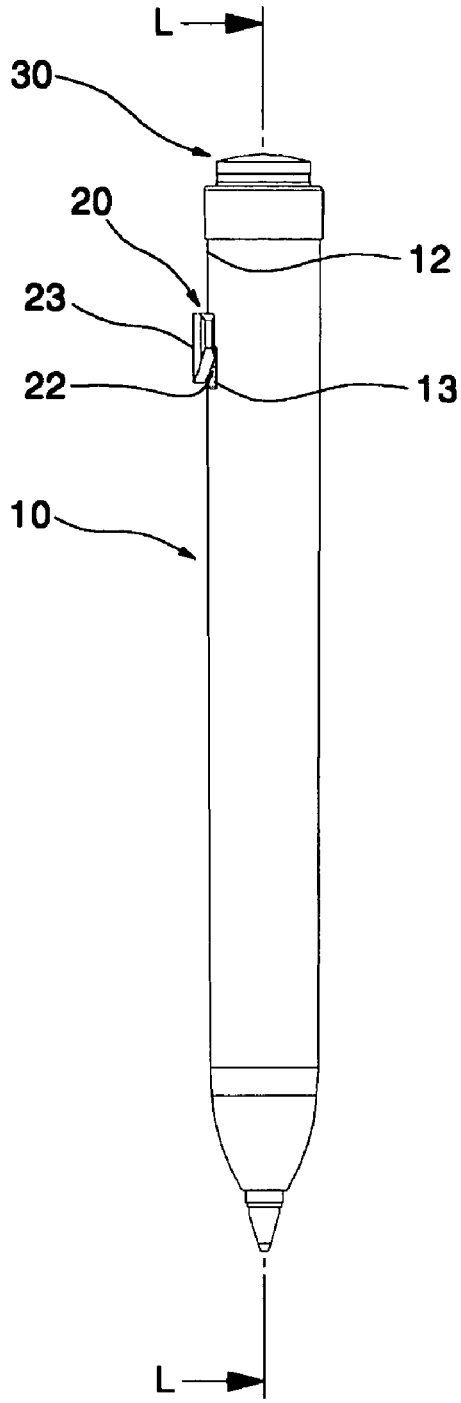
Figure 9B:
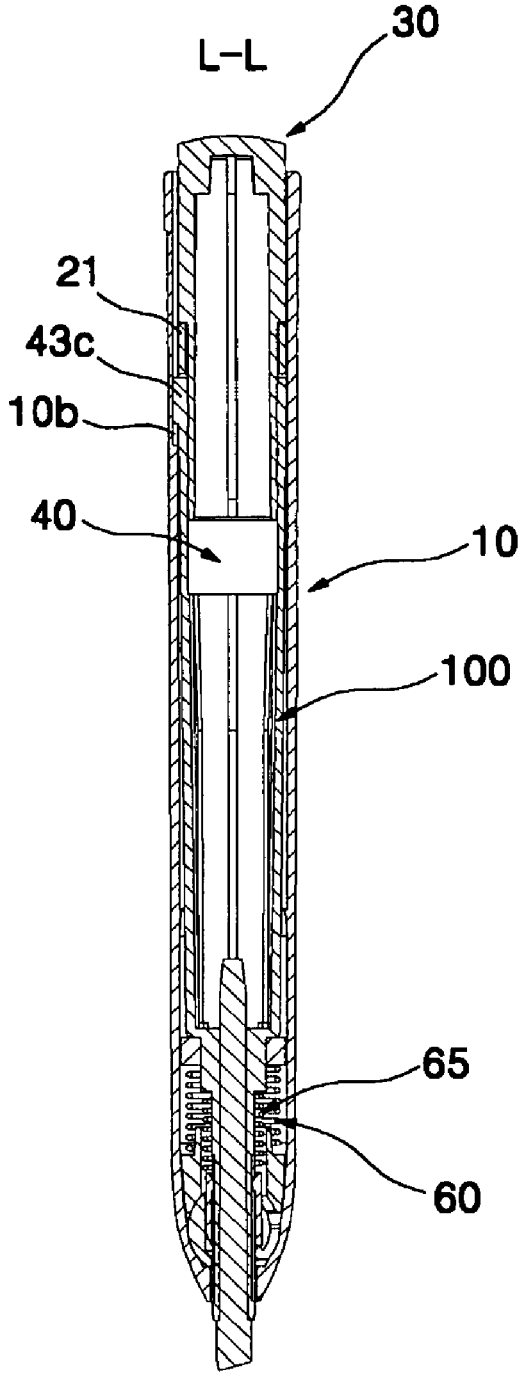

FIG. 9*a* is a side view of the writing instrument of FIG. 1*a*, and FIG. 9*b* is a sectional view taken along the line L—L of FIG. 9*a* to illustrate an assembled state of the writing instrument.

An internal operating module 100 having the above-mentioned elements is provided in the shaft 10.

In the internal operating module 100, the knock part 30 is fitted into the cartridge 40.

Particularly, the ring 21 of the switch 20 is rotatably installed between the knock part 30 and the cartridge 40.

When a user desires to lock the switch 20, the coupling shaft 22 of the switch 20 moves forward along the shaft guide slit 21, together with the knock part 30 and the cartridge 40. Subsequently, the coupling shaft 22 rotates at a junction between the shaft guide slit 12 and the stepped slot 13 at a rotating angle corresponding to a depth of the stepped slot 13, and then is locked to the stepped slot 13.

Meanwhile, when the user desires to unlock the switch 20, the coupling shaft 22 of the switch 20 rotates at the same rotating angle as the locking angle but in a direction opposite to the locking direction. Thus, the coupling shaft 22 of the switch 20 is released, and then moves backward along the shaft guide slit 12 by the first and second springs 60 and 65.

Referring to FIGS. 10*a* through 10*c*, and FIGS. 11*a* through 11*c*, the forward operation of the internal operating module 100 provided in the shaft 10 will be described in brief in the following.

Figure 10A:
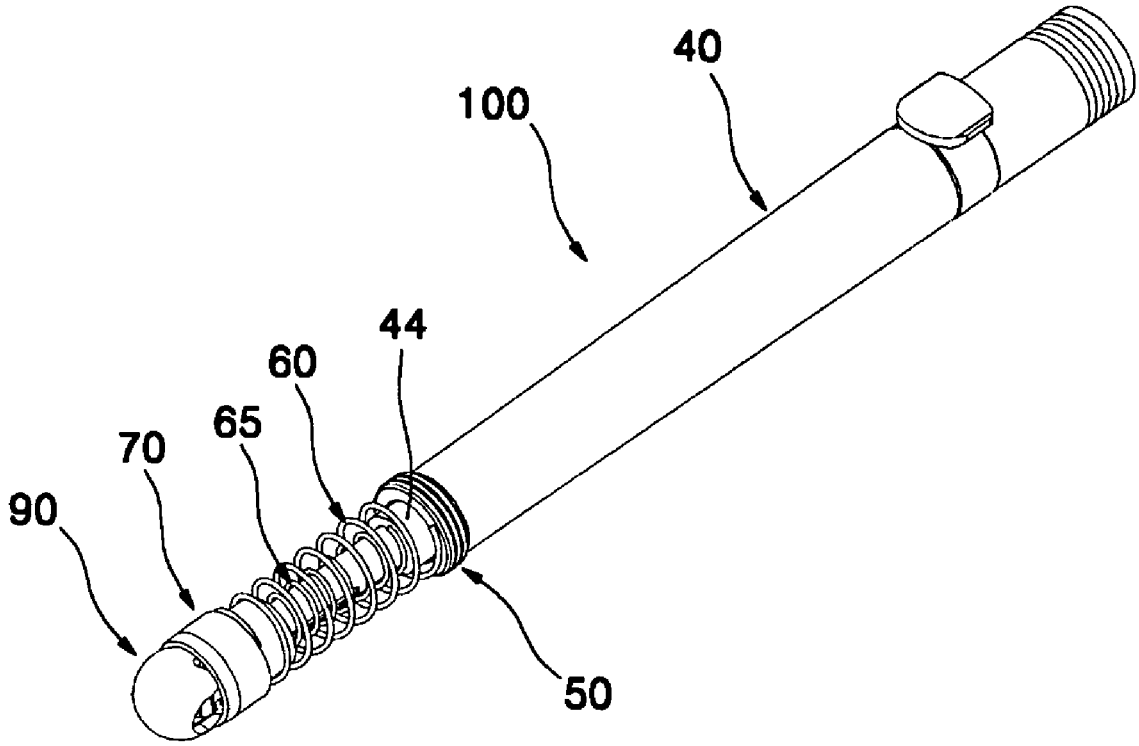
FIGS. 10*a* through 10*c* are schematic perspective views to illustrate a forward operation of an internal operating module of the writing instrument shown in FIG. 2, except the shaft.
Figure 11A:
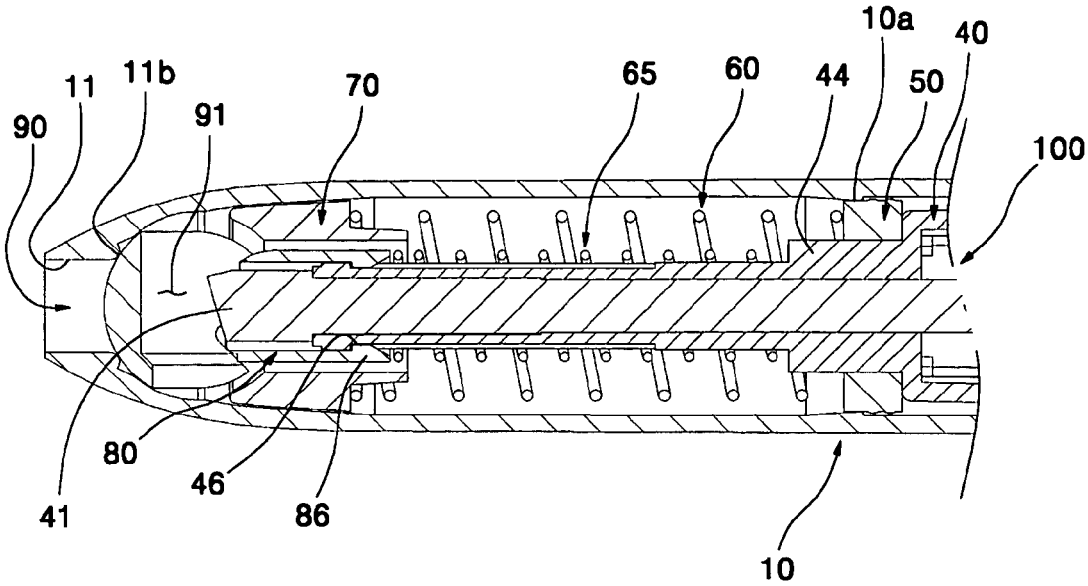
FIGS. 11*a* through 11*c* are detailed sectional views to illustrate the retraction and projection of a nib included in the writing instrument of FIG. 2.

FIGS. 10*a* and 11*a* show the state where the nib hole 11 is closed by the spherical door 90, at the first stroke start position. That is, the passage 91 of the spherical door 90 is perpendicular to a central axis of the cartridge 40. In this case, a part of the spherical door 90 is in line contact with the door seat 11*b* provided around the nib hole 11 of the shaft 10, thus sealing the interior of the shaft 10.

Further, the O-ring 50 is fitted over the coupling part 44 of the cartridge 40. Since the O-ring 50 is in close contact with the annular projection 10*a* and the spherical door 90 is in close contact with the nib hole 11, the interior space of the shaft 10 between the nib hole 11 and the O-ring 50 is sealed, thus preventing ink from being dried up.

At this time, the nib 41 is surrounded with the link 80. The link projections 86 of the link 80 slidably engage with the corresponding cartridge guide grooves 46 of the nib extension part 45. In this case, the outer surfaces of the link projections 86 are in contact with the inner surfaces of the front portions of the cartridge guide grooves 46.

The first spring 60 acts as an elastic force, which is sufficient to rotatably support the spherical door 90, on the link holder 70, so that the spherical door 90 is seated in the shaft 10. Meanwhile, the second spring 65 is maintained between the link 80 and the coupling part 44 without generating any elastic force.

Figure 10B:
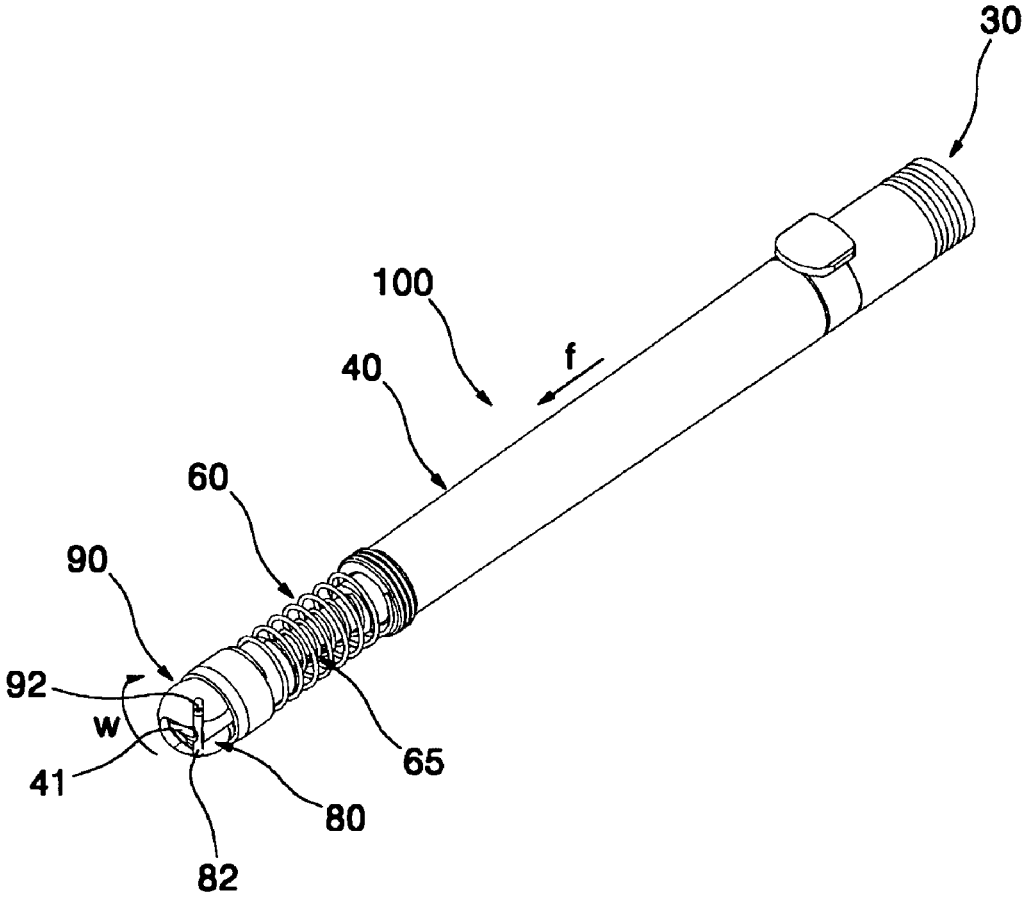
Figure 11B:
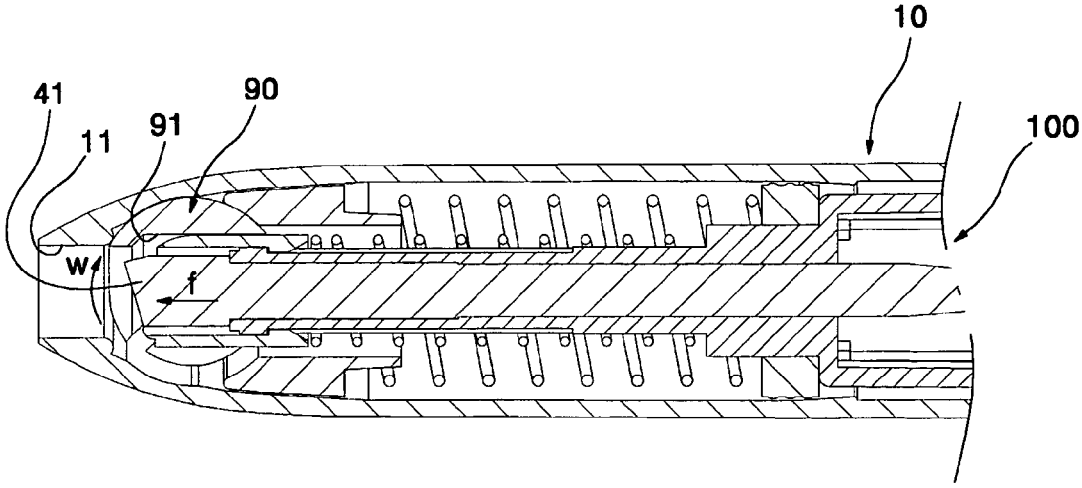

FIGS. 10*b* and 11*b* show the state where the knock part 30 and the cartridge 40 of the internal operating module 100 move forward by a predetermined stroke distance, for example, 4 mm, when the user presses the knock part 30 to lock the switch 20.

In this case, the first spring 60 is operated similarly to the state shown in FIGS. 10*a* and 11*a*. But, in comparison with the state shown in FIGS. 10*a* and 11*a*, the first spring 60 applies a larger elastic force to the link holder 70. Further, the second spring 65 applies a force generated during the forward movement of the cartridge 40 to the link 80, in a form of an elastic restoring force.

Thus, as shown by the arrow f of FIG. 11*b*, the link 80 moves forward by the predetermined stroke distance. The parallel pin 82 of the link 80 slides along the pin slits 92 of the spherical door 90. Thus, the spherical door 90 rotates by the rotating angle of +90° in a direction W.

Therefore, the passage 91 of the spherical door 90 is opened in the axial direction of the cartridge 40. Further, the link 80 and the nib 41 which have moved forward are placed in the passage 91.

At this time, the nib 41 of the cartridge 40 is positioned in the passage 91 so that a writing tip of the nib 41 is not in contact with any wall of the passage 91 of the spherical door 90. Thus, no portion of the spherical door 90 is covered with ink of the nib 41. At this time, a user can see an end of the nib 41 positioned inside the nib hole 11, with the naked eye.

Figure 10C:
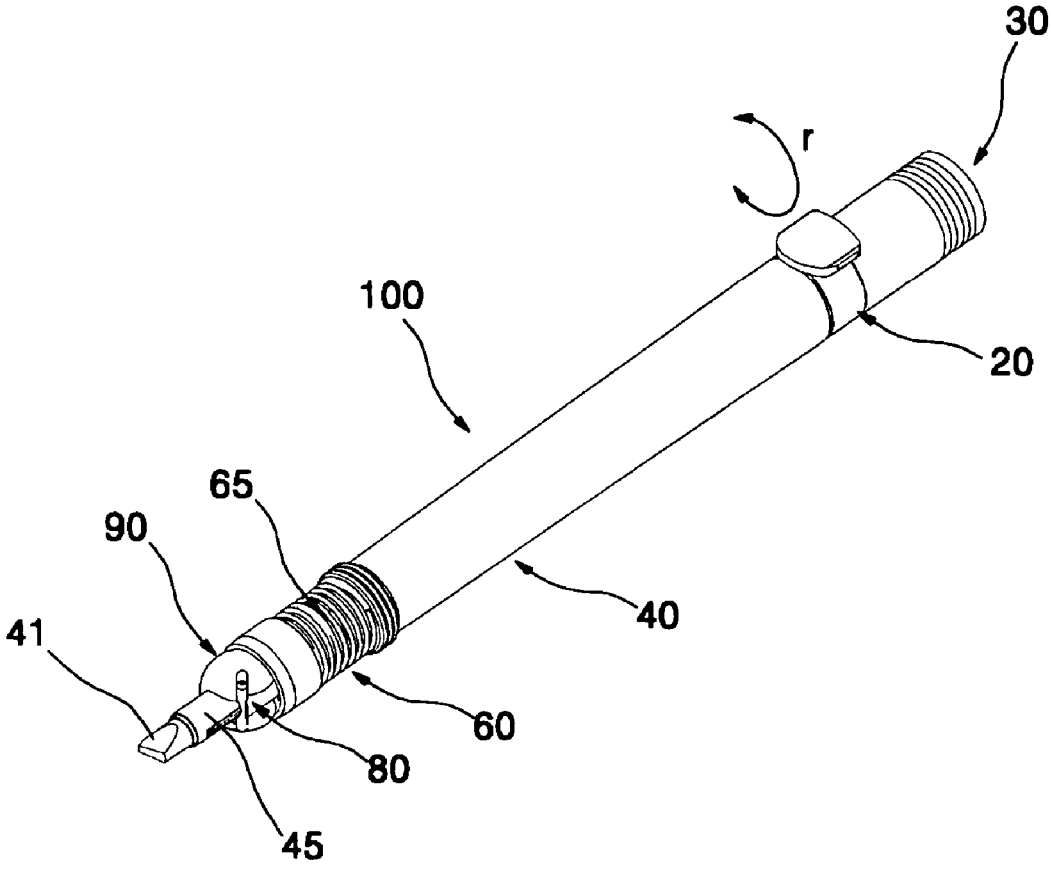
Figure 11C:
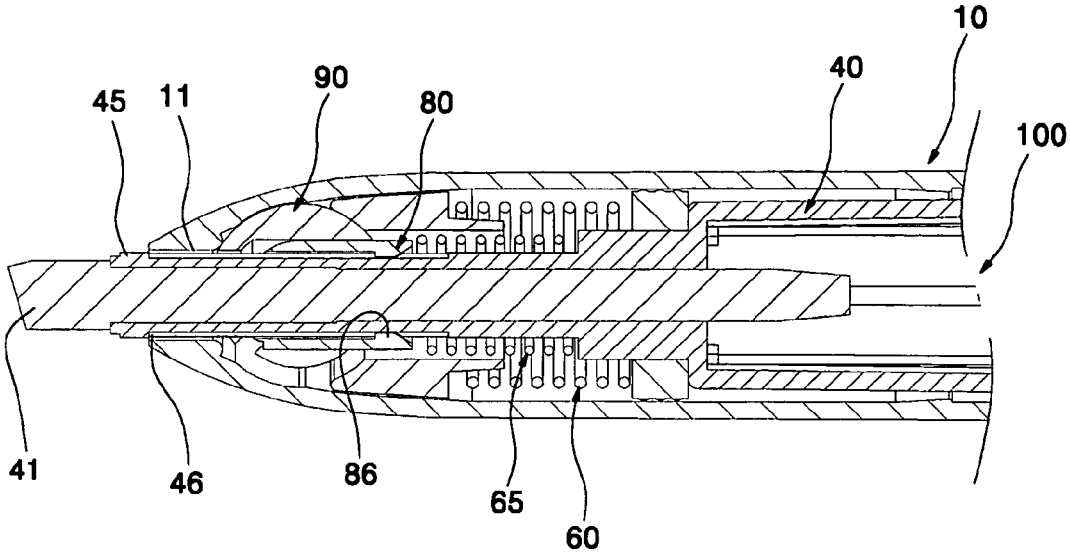

FIGS. 10*c* and 11*c* show the state where the internal operating module 100 is further moved forward by a predetermined stroke distance, for example, 12 mm, to lock the switch 20 to the stepped slot 13.

As described above, the user rotates the switch 20 by a predetermined rotating angle so that the switch 20 is stopped by the stepped slot 13 of the shaft guide slit 12. Thus, the internal operating module 100 is secured in the shaft 10.

Further, the nib 41 and a part of the nib extension part 45 are projected out of the nib hole 11.

Since the first and second springs 60 and 65 move forward by the total stroke distance, for example, 16 mm, the first and second springs 60 and 65 are maximally compressed within elastic limits thereof. Thus, the first and second springs 60 and 65 retain maximum elastic restoring forces.

In such a state, the user can write with the writing instrument of this invention.

Conversely, when the user manipulates the switch 20 to unlock the switch 20, the nib 41 is retracted into the shaft 10.

That is, the user rotates the switch 20 in a direction which releases the coupling shaft 22 of the switch 20 from the stepped slot 13 of the shaft guide slit 12.

In this case, the nib retracting operation is executed in reverse order to the nib projecting operation shown in FIGS.

11*a* through 11*c*. Through such a nib retracting operation, the nib hole 11 is closed by the spherical door 90, and the nib 41 is safely sealed in the shaft 10.

That is, as soon as the first and second springs 60 and 65 extend in an axial direction by the elastic restoring forces, the switch 20, the knock part 30, and the cartridge 40 of the internal operating module 100 move backward.

At this time, the nib extension part 45 moves backward together with the cartridge 40, but the link projections 86 are maintained in their stopped state. When the nib 41 is retracted into a position shown by FIG. 10*b* or 11*b*, the cartridge guide grooves 46 of the nib extension part 45 allow the link projections 86 to slide relative to the cartridge guide grooves 46.

Thereafter, when the inner surfaces of the front portions of the cartridge guide grooves 46 come into contact with the outer surfaces of the link projections 86, the nib 41 is placed in the passage 91 of the spherical door 90.

Later, as the cartridge 40 moves further backward, the inner surfaces of the cartridge guide grooves 46 come into contact with the outer surfaces of the link projections 86 of the link 80, and then the cartridge guide groove 46 pulls the link projections 86 of the link 80 backward.

In this case, the parallel pin 82 of the link 80 rotates the spherical door 90 by the rotating angle of −90°. At this time, the spherical door 90 seals the nib hole 11.

<Second Embodiment>

A slide-type writing instrument with a dry prevention unit, according to a second embodiment of this invention, will be described in detail in the following with reference to FIGS. 12 through 18*m*.

Figure 12:
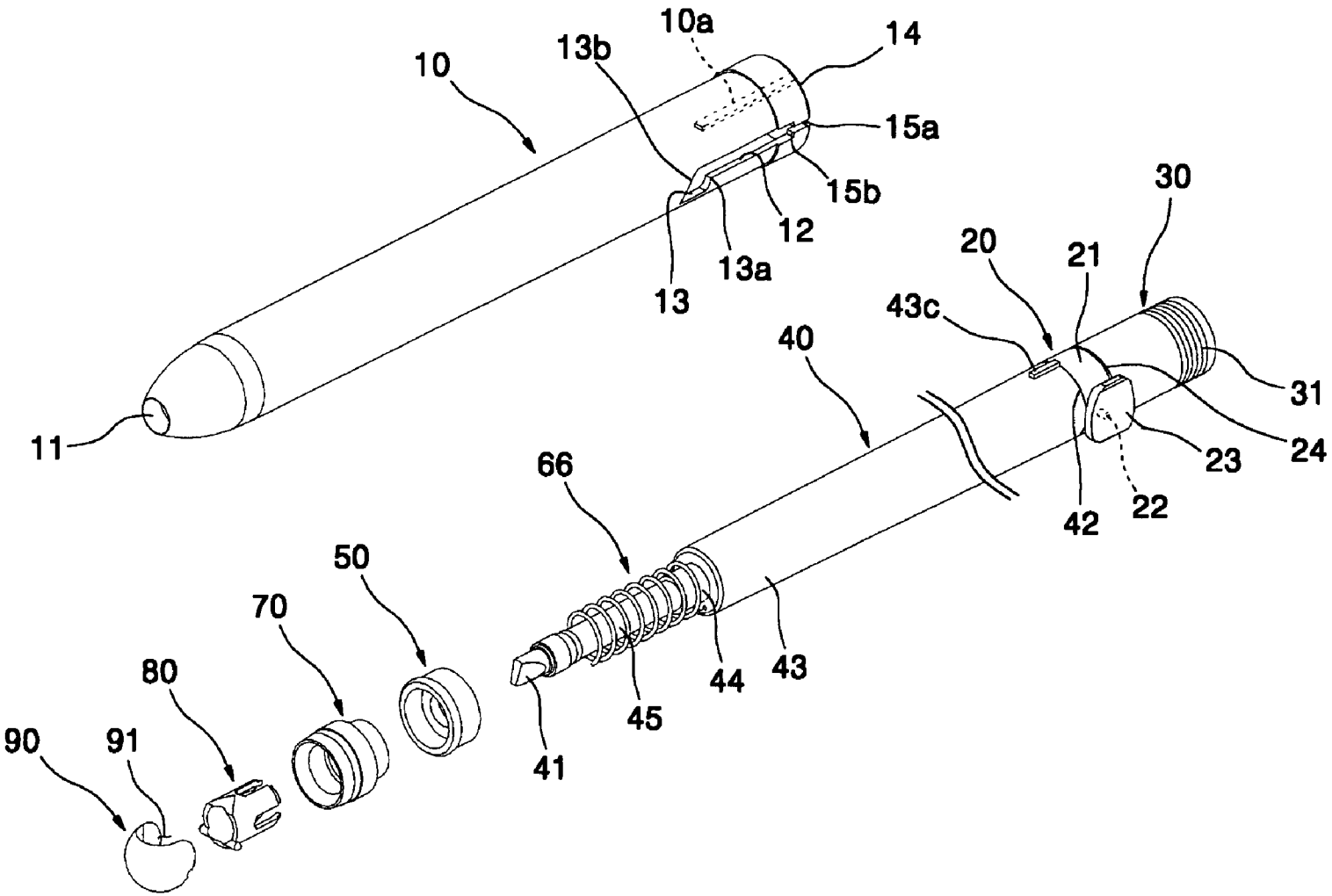
FIG. 12 is an exploded perspective view of a slide-type writing instrument with a dry prevention unit, according to a second embodiment of the present invention.

As shown in FIG. 12, the writing instrument of this invention opens or closes a nib hole 11 of a shaft 10. A switch 20 is provided in the shaft 10 to be locked and unlocked, and is coupled to a knock part 30 which transmits a pressing force of a user. A cartridge 40 is axially fitted into the knock part 30. A spring 66 is coupled to the cartridge 40 to return the cartridge 40 to an original position thereof, using an elastic force of the spring 66. An O-ring 50 is slidably installed in the shaft 10 to seal a gap between the shaft 10 and the cartridge 40. Further, a link holder 70 is installed in the shaft 10 while an end of the link holder 70 being axially inserted into the O-ring 50. A link 80 is slidably installed in the link holder 70. A spherical door 90 is also installed in the shaft 10. A parallel pin 82 of the link 80 engages with pin slits 92 of the spherical door 90, thus rotating the spherical door 90 by a predetermined rotating angle corresponding to a sliding motion of the link 80.

Further, the second embodiment of this invention can be applied to a cartridge control unit of a conventional knock-type ballpoint pen as well as a cartridge control unit using the switch 20 and the shaft guide slit 12 according to the first embodiment.

Of course, the knock part 30 of this invention may be designed in a similar manner as a clip having a gear seating part in which a gear unit is rotatably seated. The structure having such a clip is disclosed in detail in Korean Patent No. 10-2003-55414 and 10-2003-56940, which relates to a safe knock-type writing instrument and is filed with KIPO by the same applicant as this invention.

Figure 13:
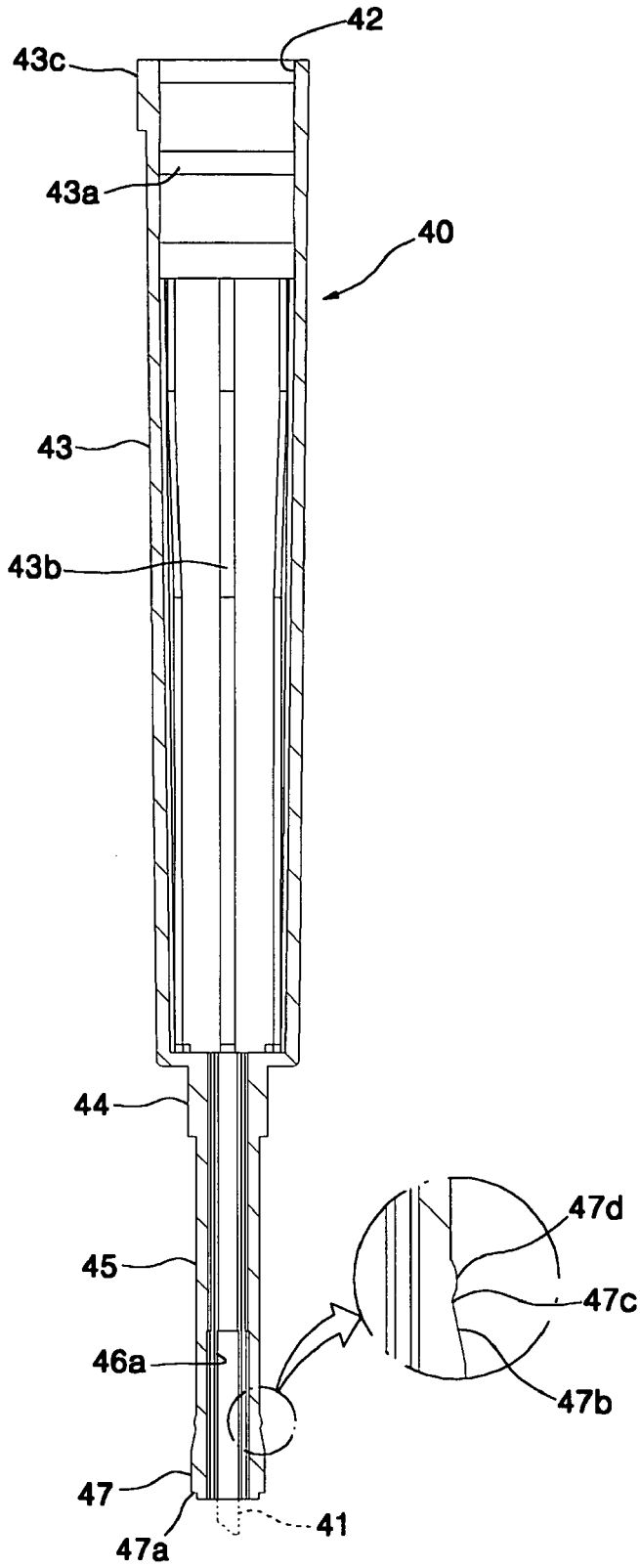
FIG. 13 is a sectional view of a cartridge included in the writing instrument of FIG. 12.

As shown in FIG. 13, the cartridge 40 has a nib extension part 45 which is designed as follows.

That is, a clutch part 47 having a circular cross-section is provided on an outer circumference of an end of the nib extension part 45 so that a diameter of the clutch part 47 is larger than a diameter of the nib extension part 45.

A stepped portion 47*a*, having a smaller diameter than the clutch part 47, is provided at an end of the clutch part 47.

In order to pull the link 80 of FIG. 12 backward, the clutch part 47 includes a tapered surface 47*b* at a position around the stepped portion 47*a*. A clutch recess 47*c* having a semi-circular cross-section is provided at a position around the tapered surface 47*b*, and a non-skid projection 47*d* having a semi-circular cross-section is provided at a position around the clutch recess 47*c*.

The spring 66 is fitted over the nib extension part 45 to be supported by a stepped junction between a tank part 43 and a coupling part 44.

Such a spring 66 is seated on a spring seat 56 of the O-ring 50, which will be described in detail hereinafter.

Thereafter, the spring 66 axially biases either the O-ring 50 or the cartridge 40, within a stroke distance of the cartridge 40, during the operation of the writing instrument.

For example, when the cartridge 40 and the knock part 30 move forward by a predetermined stroke distance, the spring 66 is compressed, and thereby retains an elastic restoring force which makes the spring 66 return to an original state thereof. In this case, the predetermined stroke distance of the cartridge 40 is equal to a stroke distance of the knock part 30 or a distance between an original position and a projecting position of the nib 41. Further, when the switch 20 is released to move the cartridge 40 and the knock part 30 backward, the elements coupled to the cartridge 40 as well as the knock part 30 return to original positions thereof by the elastic force of the spring 66.

Further, when a pressing force of a user to move the cartridge 40 and the knock part 30 forward is applied to one of the O-ring 50, the link holder 70, and the spherical door 90, the spring 66 functions to attenuate impact on the O-ring 50, the link holder 70, and the spherical door 90.

Figure 14:
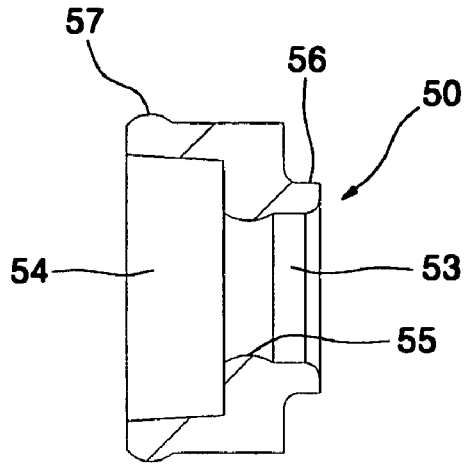
FIG. 14 is a sectional view of an O-ring included in the writing instrument of FIG. 12.

As shown in FIG. 14, a smaller diameter hole 53 and a larger diameter hole 54 of the O-ring 50 form an alignment with a central axis of the O-ring 50, thus allowing the O-ring 50 to be fitted over the coupling part 44 of the cartridge 40.

The spring seat 56 is provided at a position around the smaller diameter hole 53 to be axially projected. Further, a first sealing projection 55 having a semi-circular cross-section is provided at a junction between the smaller diameter hole 53 and the larger diameter hole 54. The first sealing projection 55 is in contact with an outer circumferential surface of the nib extension part 45, thus sealing a gap between the nib extension part 45 and the O-ring 50 during the sliding motion of the cartridge 40.

Further, a second sealing projection 57 having a semi-circular cross-section is provided on an outer circumferential surface of the larger diameter hole 54. The second sealing projection 57 is in contact with an inner circumferential surface of the shaft 10, thus sealing a gap between the shaft 10 and the O-ring 50 during the sliding motion of the cartridge 40. Preferably, the second sealing projection 57 may further have a grooved outer surface, thus reducing friction between the shaft 10 and the O-ring 50 during the sliding motion of the cartridge 40, and maximizing sealing performance.

Figure 15:
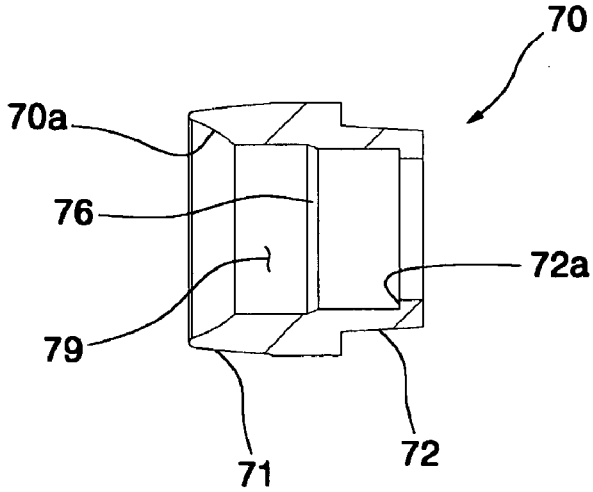
FIG. 15 is a sectional view of a link holder included in the writing instrument of FIG. 12.

As shown in FIG. 15, the link holder 70 is supported by the O-ring 50 which is fitted over the nib extension part 45 and is biased by the spring 66, so that the link holder 70 makes the spherical door 90 of FIG. 12 come into contact with a rounded surface inside the nib hole 11 of the shaft 10.

An axial length of a rear part 72 of the link holder 70 according to the second embodiment is slightly longer than that of the first embodiment.

The rear part 72 of the link holder 70 has a diameter corresponding to a size of the larger diameter hole 54 of the O-ring 50.

A link mount hole 79 is formed at a center of the link holder 70. In this case, the link 80 freely slides forward in the link mount hole 79, but limitedly slides backward due to the constructions of the link 80 and the link holder 70 which will be described in the following.

Figure 16:
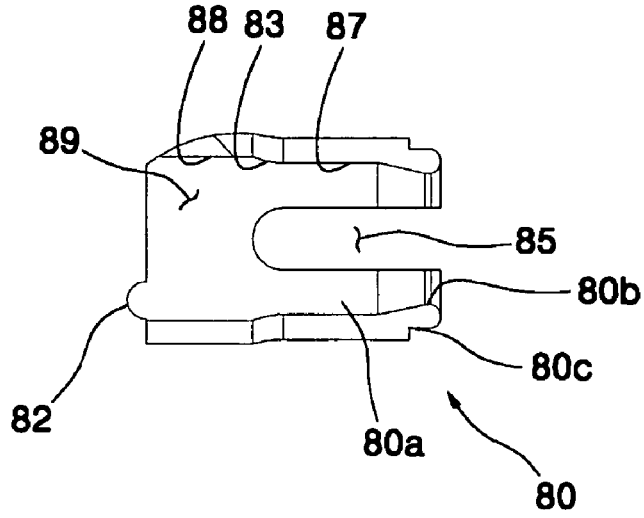
FIG. 16 is a sectional view of a link included in the writing instrument of FIG. 12.
Figure 18A:
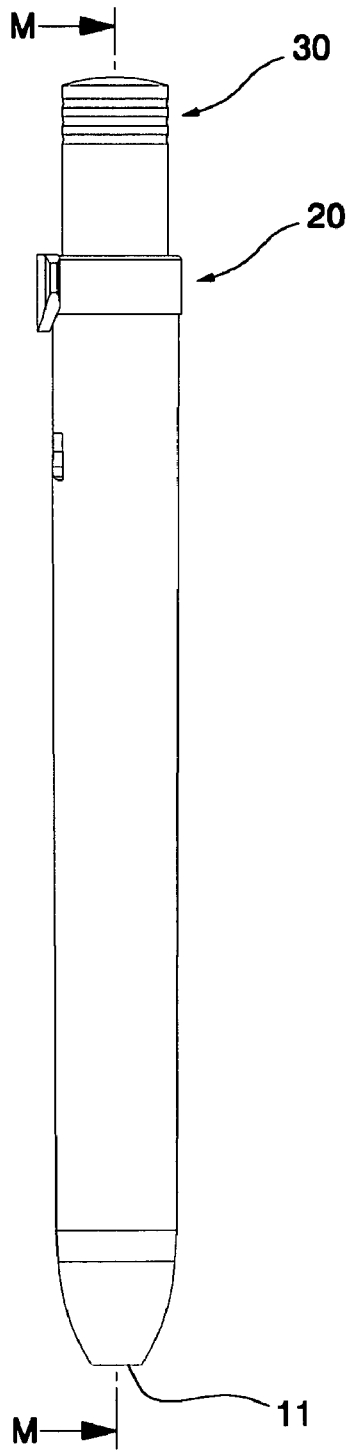
FIGS. 18*a* through 18*m* are views to illustrate assembly and operations of the writing instrument of FIG. 12.
Figure 18B:
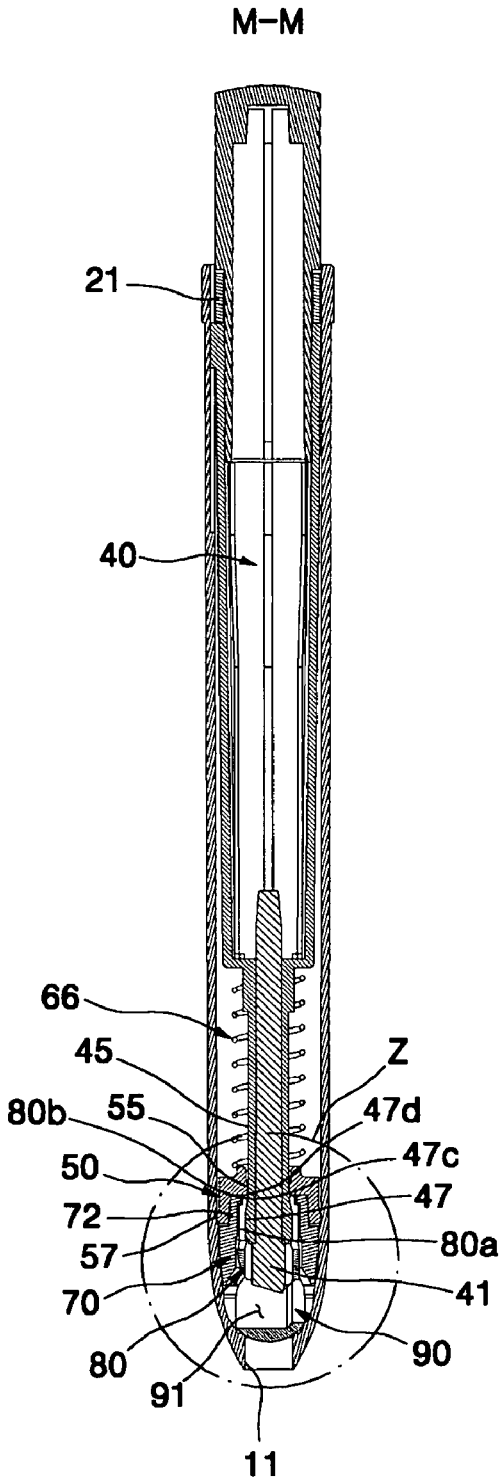
Figure 18C:
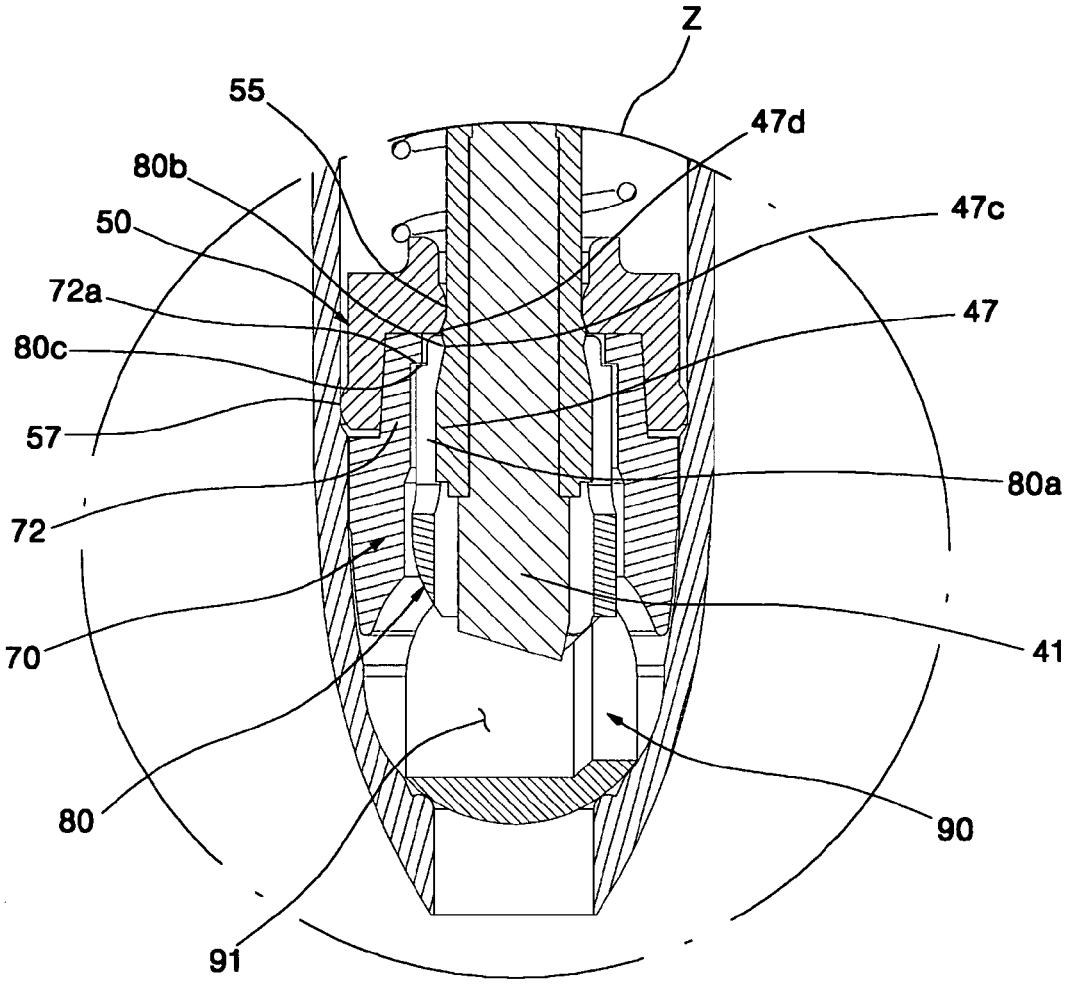

That is, support steps 72*a* are provided at an end of an inner circumference of the rear part 72 of the link holder 70 to stop fitting steps 80*c* of the link 80 shown in FIG. 16 in detail, thus limiting the sliding motion of the link 80 (see, FIG. 18*c*).

Further, an inclined step 76 extends from a middle portion of the link mount hole 79 in a circumferential direction to correspond to the shape of the link 80, thus preventing the link 80 from being adhered to the link holder 70 by impurities after a lengthy use, and aligning the link 80 with the center of the link mount hole 79.

As shown in FIG. 16, an inner circumference of a link hole 89 of the link 80 is formed to correspond to the link mount hole 79, the support step 72*a,* and the inclined step 76 of the link holder 70, so that the link 80 is inserted into the link holder 70 to be sealed in the link holder 70.

In a detailed description, a larger diameter part 88 is provided on the inner circumference of the link hole 89 in front of an inclined surface 83, while a smaller diameter part 87 is provided on the inner circumference of the link hole 89 in back of the inclined surface 83. In this case, the smaller diameter part 87 corresponds to inner circumferences of elastic pieces 80*a,* which will be described later.

A plurality of elastic slits 85 are formed on the link 80 at regular angular intervals, for example, 90° in a circumferential direction of the link 80. In this case, only an end of each elastic slit 85 is opened.

The elastic slits 85 are provided on a rear portion of the link 80, and the plurality of elastic pieces 80*a* are respectively provided between the elastic slits 85.

The fitting step 80*c* is provided on an outer circumference of a rear end of each elastic piece 80*a* of the link 80, while an elastic projection 80*b* is provided on an inner circumference of the rear end of each elastic piece 80*a*.

In this case, each elastic projection 80*b* is shaped to be seated in the clutch recess 47*c* of the clutch part 47 shown in FIG. 13.

There is a close relationship between the operation of each elastic projection 80*b* and the operation of the clutch part 47.

That is, when the cartridge 40 starts sliding in an axial direction, the clutch part 47 also starts sliding.

At first, the elastic projection 80*b* of each elastic piece 80*a* is seated in the clutch recess 47*c* of the clutch part 47 shown in FIG. 13 while being supported by the non-skid projection 47*d*. Further, each elastic projection 80*b* temporarily engages with the clutch part 47 of the cartridge 40 by a frictional force corresponding to an elastic force of the elastic projection 80*b*.

Thus, the link 80 having the elastic projections 80*b* slides along with the cartridge 40 having the clutch recess 47*c,* while engaging with the cartridge 40.

Further, when the link 80 is stopped by the step 93 of the passage 91 of the spherical door 90 (see, FIG. 17), the link 80 does not slide any more.

In this case, when the sliding motion is continuously executed within a predetermined stroke range, the elastic pieces 80*a* are flared relative to the elastic slits 85, and then return to an original state thereof. In such a process, the elastic projection 80*b* of each elastic piece 80*a* is removed from the clutch recess 47*c* of the clutch part 47. As a result, even when the link 80 is stopped, the cartridge 40 can move forward.

Further, a parallel pin 82 is provided at a lower end of a front portion of the link 80 to be perpendicular to a central axis of the link 80. In this case, the parallel pin 82 is slightly outwardly projected at opposite ends thereof. The opposite ends of the parallel pin 82 are chamfered to correspond to the rounded part of the spherical door 90.

The parallel pin 82 engages with pin slits 92 of the spherical door 90, so that the link 80 functions to rotate the spherical door 90 at a rotating angle of ±90° in a direct transmission manner.

Figure 17:
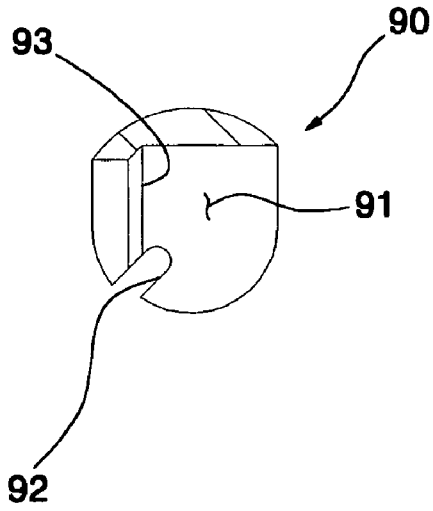
FIG. 17 is a sectional view of a spherical door included in the writing instrument of FIG. 12.

Referring to FIGS. 12 and 17, the spherical door 90 serves as a driven unit of the link 80. As a result, the spherical door 90 serves as a door to open or close the nib hole 11.

For a smooth operation, the door 90 has a roughly spherical shape. Further, a passage 91 is formed to pass through a center of the spherical door 90 while being opened at both sides of an outer circumference of the spherical door 90.

The plurality of pin slits 92 are provided at eccentric positions of the spherical door 90 to receive the parallel pin 82 of the link 80.

In this case, the pin slits 92 are formed at opposite sides of the passage 91 to be inclined at a predetermined angle.

The pin slits 92, formed to be inclined at the eccentric positions of the spherical door 90, receive the parallel pin 82, thus functioning as a cam slit. That is, the pin slits 92 receiving the parallel pin 82 convert a link sliding force into a rotating force that rotates the spherical door 90 within a predetermined angular range.

Further, the step 93 is provided on an inner circumference of a front portion of the passage 91, thus limiting a stroke of the link 80.

The assembly of the above-mentioned elements will be described in the following.

FIG. 18*a* is a side view of the writing instrument according to the second embodiment, and FIG. 18*b* is a sectional view taken along the line M—M of FIG. 18*a,* and FIG. 18*c* is an enlarged view of a portion encircled in FIG. 18*b*. As shown in the drawings, the above-mentioned elements are assembled in the shaft 10.

That is, the cartridge 40 is seated in the shaft 10, and the knock part 30 is fastened to an end of the cartridge 40 through a force-fit method.

The ring 21 of the switch 20 is rotatably provided between the knock part 30 and the cartridge 40.

When a user desires to lock the switch 20, the coupling shaft 22 of the switch 20 moves forward along the shaft guide slit 12, together with the knock part 30 and the cartridge 40. Subsequently, the coupling shaft 22 rotates at a junction between the shaft guide slit 12 and the stepped slot 13 at a rotating angle corresponding to a depth of the stepped slot 13, and then is locked to the stepped slot 13.

Meanwhile, when the user desires to unlock the switch 20, the coupling shaft 22 of the switch 20 is rotated at the same rotating angle as the locking angle but in a direction opposite to the locking direction. Thus, the coupling shaft 22 of the switch 20 is released, and then moves backward along the shaft guide slit 12 by the spring 66.

In a detailed description, at a first stroke start position; the spherical door 90 closes the nib hole 11.

That is, the passage 91 of the spherical door 90 is perpendicular to the central axis of the cartridge 40.

The O-ring 50 is arranged between the link holder 70 and the spring 66. In this case, the larger diameter hole 54 of the O-ring 50 surrounds the rear part 72 of the link holder 70. Further, the first sealing projection 55 of the O-ring 50 is in surface contact with the outer circumferential surface of the nib extension part 45 of the cartridge 40, while being in close contact with the non-skid projection 47*d*. Furthermore, the second sealing projection 57 is in surface contact with the inner circumferential surface of the shaft 10.

If any slit is formed on the nib extension part 45, the sealing performance may be deteriorated. However, according to the present invention, no slit is formed on the outer circumferential surface of the nib extension part 45.

As described above, because a seal is accomplished by the O-ring 50 and the spherical door 90 is in close contact with the nib hole 11, an interior of the shaft 10 between the nib hole 11 and the O-ring 50 is sealed, thus preventing ink of the nib 41 from being dried up.

Further, the O-ring 50 surrounds the rear part 72 of the link holder 70, so that a volume of the interior is smaller than a volume of the interior according to the first embodiment, thus reducing inflow of air, and thereby more efficiently preventing the drying of ink.

Meanwhile, the nib 41 is surrounded by the link 80, and the link 80 is inserted into the link mount hole 79 of the link holder 70. At this time, the elastic projection 80*b* of each elastic piece 80*a* of the link 80 is seated in the clutch recess 47*c* of the clutch part 47, thus allowing the link 80 to move along with the clutch part 47.

Further, the spring 66 acts an elastic force, which is sufficient to rotatably support the spherical door 90, on the link holder 70, so that the spherical door 90 is seated in the shaft 10.

Figure 18D:
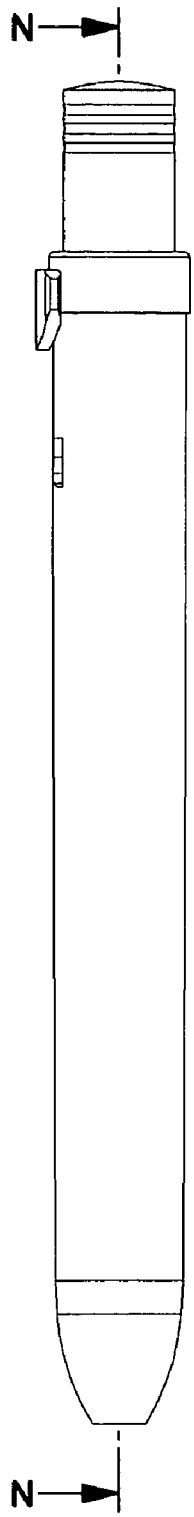
Figure 18E:
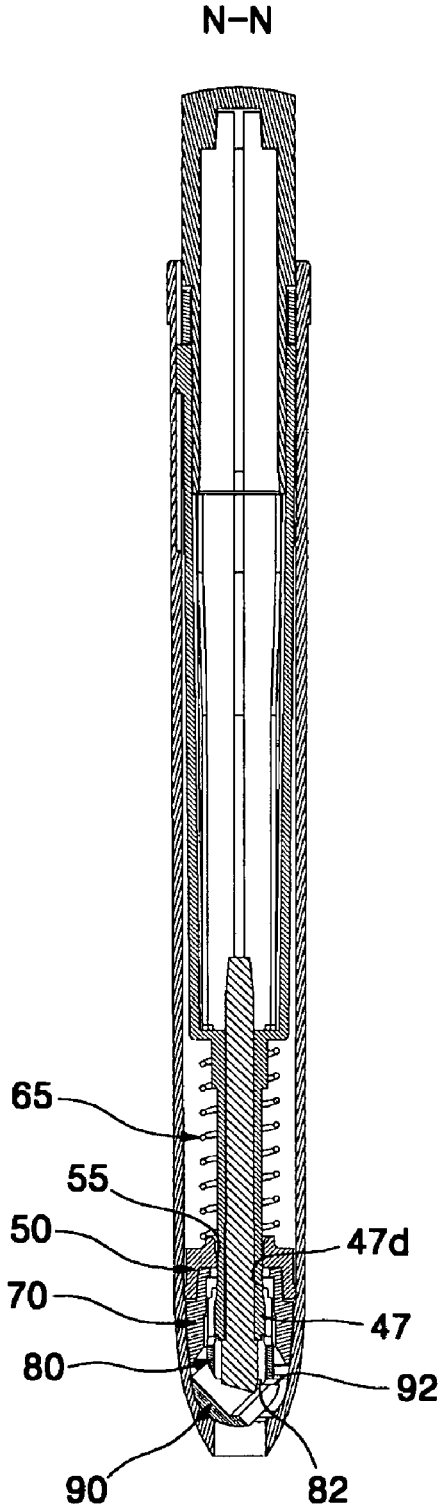

FIG. 18*d* is a side view of the writing instrument according to the second embodiment, and FIG. 18*e* is a sectional view taken along the line N—N of FIG. 18*d*. FIGS. 18*d* and 18*e* show the state where the knock part 30 and the cartridge 40 move forward by a very short stroke distance, for example, 2 mm, when a user manipulates the switch 20 or the knock part 30 so that the knock part 30 moves by the stroke distance.

At this time, the spring 66 applies a larger elastic force to the O-ring 50 and the link holder 70, according to the moving distance.

Further, the clutch part 47 of the cartridge 40 and the link 80 coupled to the clutch part 47 move by the above-mentioned stroke distance. At this time, the non-skid projection 47*d* of the clutch part 47 is separated from the first sealing projection 55 of the O-ring 50.

In this case, the parallel pin 82 of the link 80 slides along the pin slits 92 of the spherical door 90, thus rotating the spherical door 90 at a rotating angle of +45°.

Figure 18F:
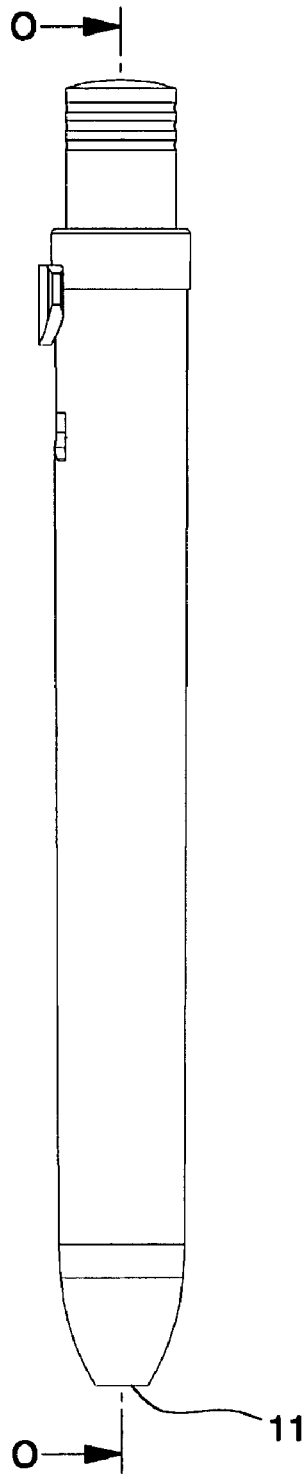
Figure 18G:
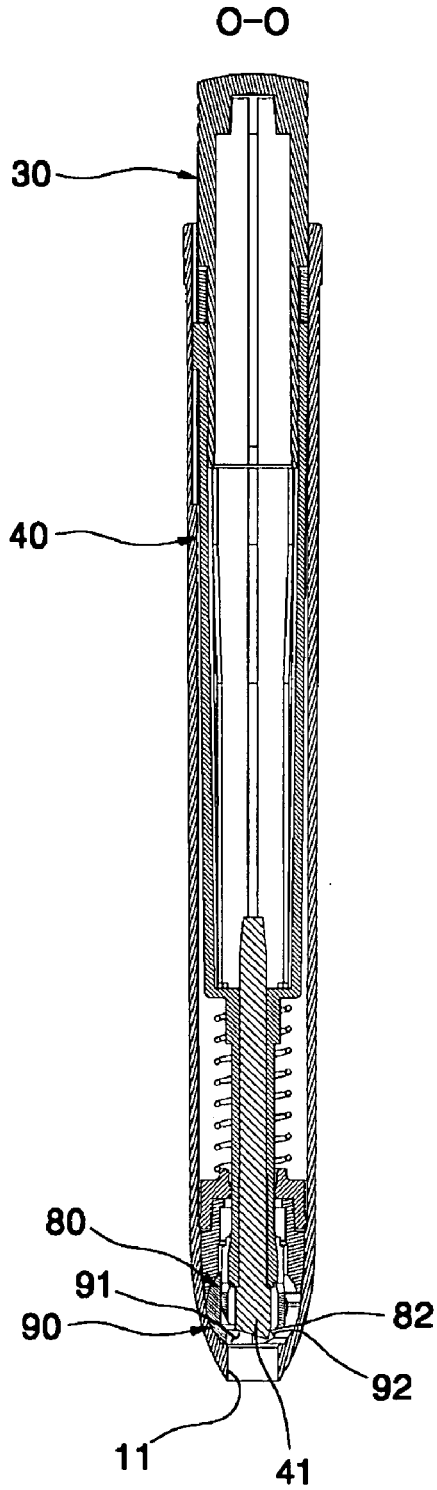

FIG. 18*f* is a side view of the writing instrument according to the second embodiment, and FIG. 18*g* is a sectional view taken along the line O—O of FIG. 18*f*. As shown in the drawings, when the user further presses the knock part 30 and the knock part 30 further moves by a predetermined stroke distance, for example, 2 mm, the knock part 30 and the cartridge 40 further move forward by the stroke distance.

In this case, the parallel pin 82 of the link 80 further slides along the pin slits 92 of the spherical door 90, thus further rotating the spherical door 90 at a rotating angle of +45°.

As a result, the passage 91 of the spherical door 90 is aligned with the central axis of the cartridge 40, thus opening the nib hole 11. At this time, the link 80 and the nib 41 are placed in the passage 91.

At this time, the nib 41 of the cartridge 40 is positioned in the passage 91 so that a writing tip of the nib 41 is not in contact with any wall of the passage 91 of the spherical door 90. Thus, no portion of the spherical door 90 is covered with ink of the nib 41. At this time, a user can see an end of the nib 41 positioned inside the nib hole 11, with the naked eye.

Figure 18H:
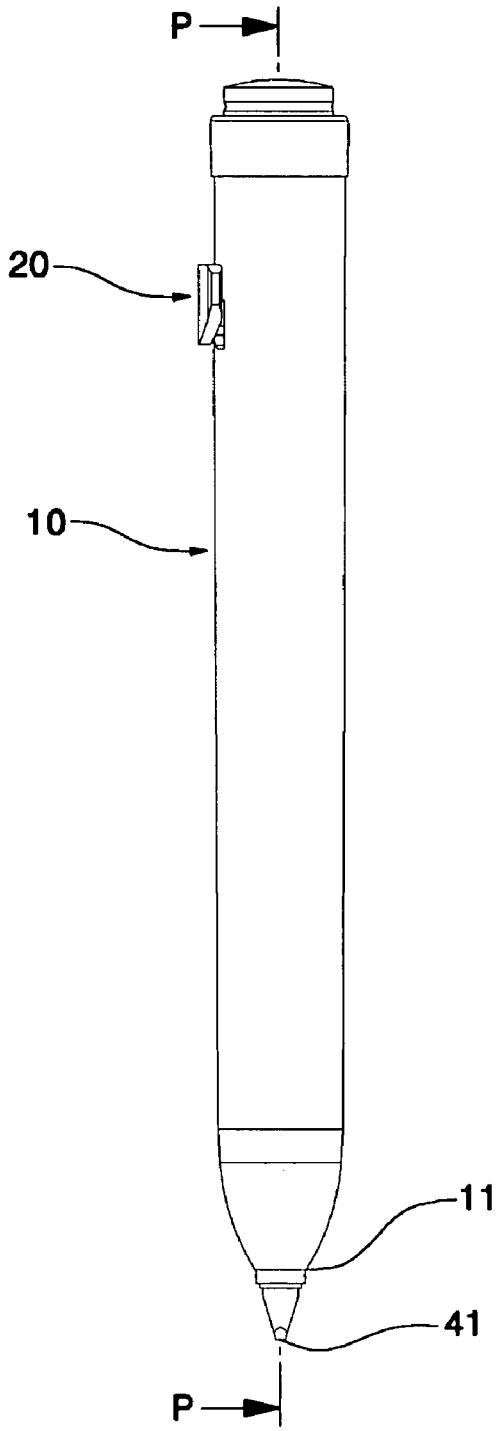
Figure 18I:
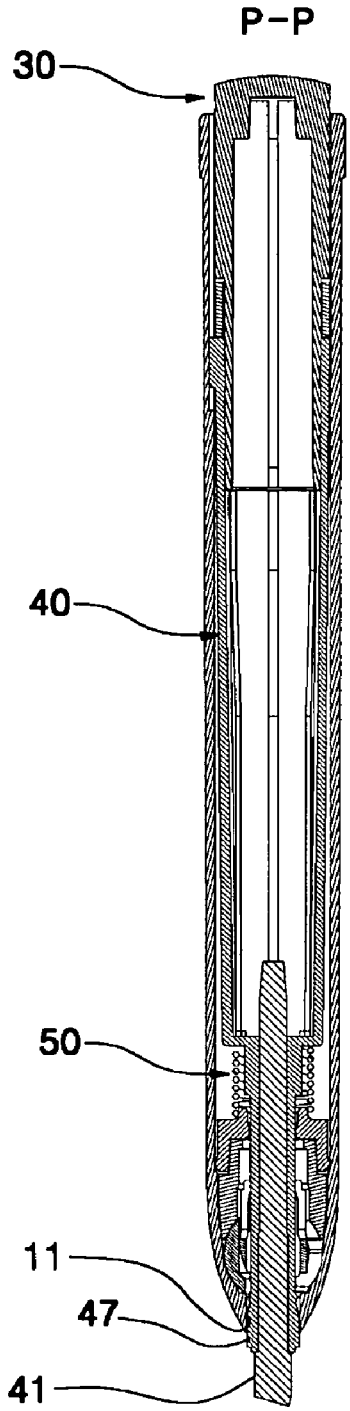

FIG. 18*h* is a side view of the writing instrument according to the second embodiment, and FIG. 18*i* is a sectional view taken along the line P—P of FIG. 18*h*. FIGS. 18*h* and 18*i* show the state where the knock part 30 further moves forward by a predetermined stroke distance, for example, 12 mm, when the user stops pressing the knock part 30.

Further, the user rotates the switch 20 by a predetermined rotating angle so that the switch 20 is stopped by the stepped slot 13 of the shaft guide slit 12. Thus, the knock part 30 and the cartridge 40 are secured in the shaft 10.

In this case, the nib 41 and a part of the clutch part 47 are projected out of the nib hole 11.

Since the spring 66 moves forward by the total stroke distance, for example, 16 mm, the spring 66 is maximally compressed within elastic limits thereof. Thus, the spring 66 retains a maximum elastic restoring force.

In such a state, the user can write with the writing instrument of the present invention.

Conversely, when the user manipulates the switch 20 to unlock the switch 20, the nib 41 is retracted into the shaft 10.

Figure 18J:
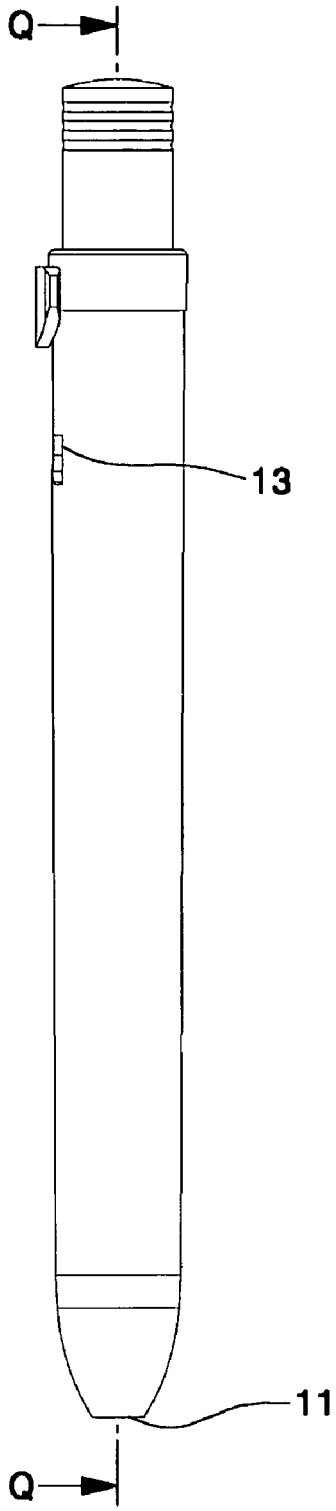
Figure 18K:
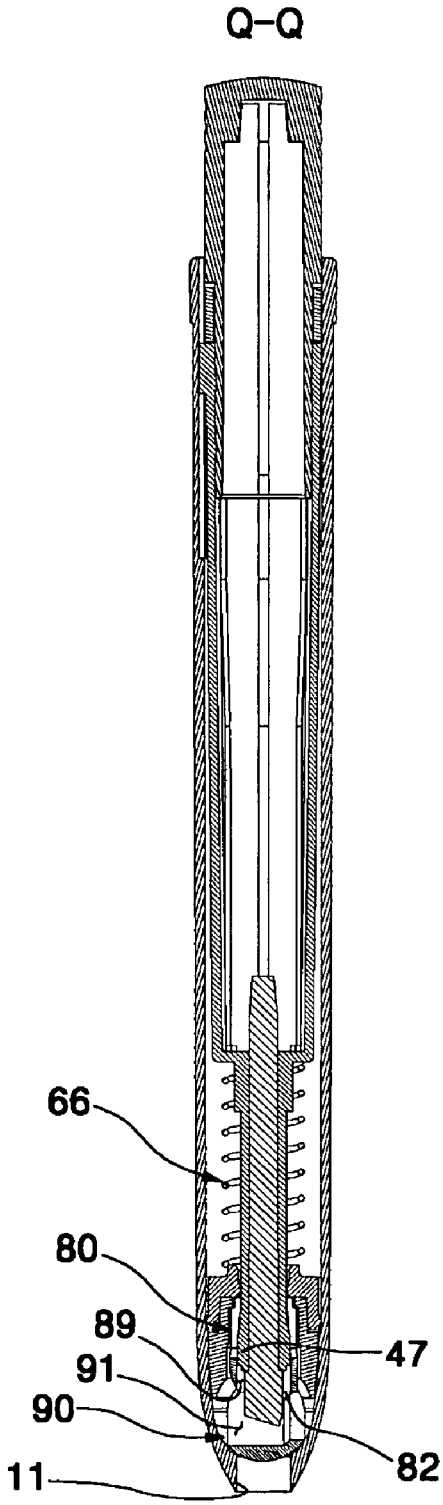

FIG. 18*j* is a side view of the writing instrument according to the second embodiment, and FIG. 18*k* is a sectional view taken along the line Q—Q of FIG. 18*j*. As shown in the drawings, the user rotates the switch 20 in a direction which releases the coupling shaft 22 of the switch 20 from the stepped slot 13 of the shaft guide slit 12.

In this case, the compressed spring 66 extends to return to an original state thereof while the knock part 30 and the cartridge 40 move backward. The nib retracting operation is executed in reverse order to the nib projecting operation.

That is, the clutch part 47 of the cartridge 40 moving backward is inserted into the link hole 89 of the link 80, and each elastic piece 80*a* of the link 80 engages with the clutch part 47, as described above.

In this case, the link 80 also moves backward along with the cartridge 40, so that the parallel pin 82 of the link 80 rotates the spherical door 90 at a rotating angle of −90°.

At this time, the spherical door 90 closes the nib hole 11, and the nib 41 is safely sealed in the passage 91 of the spherical door 90.

Figure 18L:
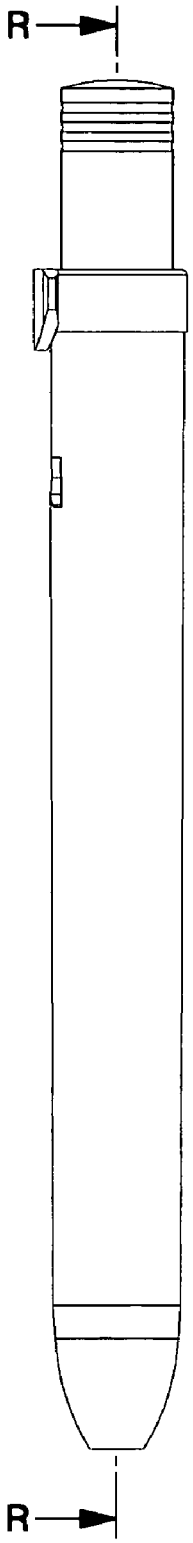
Figure 18M:
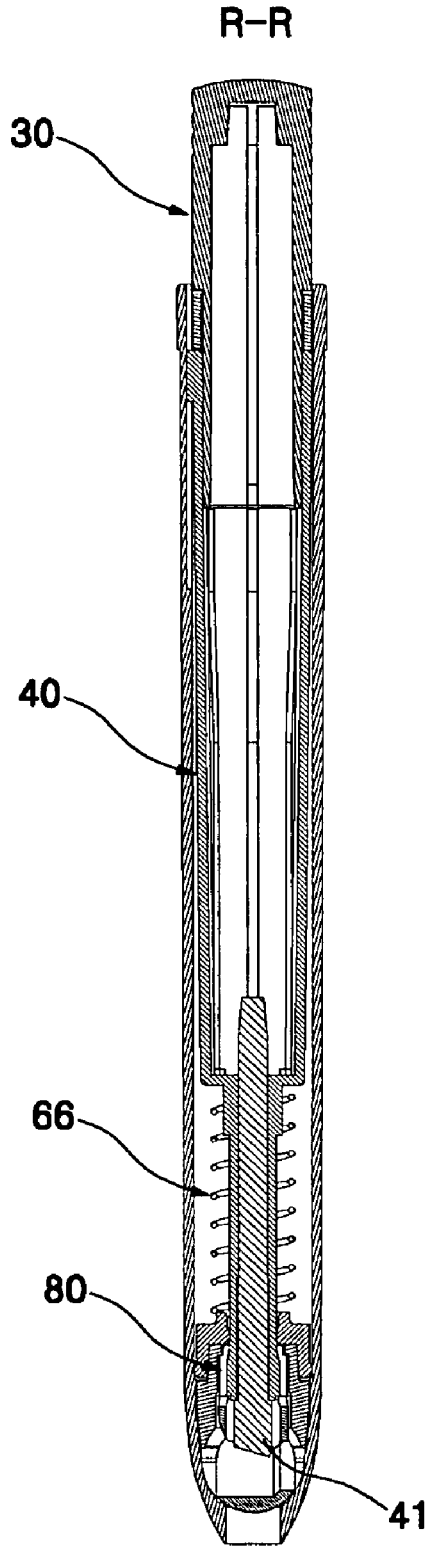

FIG. 18*l* is a side view of the writing instrument according to the second embodiment, and FIG. 18*m* is a sectional view taken along the line R—R of FIG. 18*l*. As shown in the drawings, when the spring 66 returns to the original state thereof, the knock part 30, the cartridge 40, the nib 41, and the link 80 return to the first stroke start position.

<Third Embodiment>

The general construction of a slide-type writing instrument with a dry prevention unit according to the third embodiment remains the same as the slide-type writing instrument according to the second embodiment, except that the number of a spring included in the writing instrument of the third embodiment is one more than the number of the spring included in the writing instrument of the second embodiment, and a spherical door is rotatably coupled to rotary support brackets of the link holder, so that the shapes and assembly of the spherical door, a cartridge, an O-ring, a link holder, and a link are slightly different from those of the second embodiment. Thus, the same reference numerals are used throughout FIGS. 1*a* through 20*f* to designate the same or similar components, and the common elements will not be described hereinafter.

Figure 19:
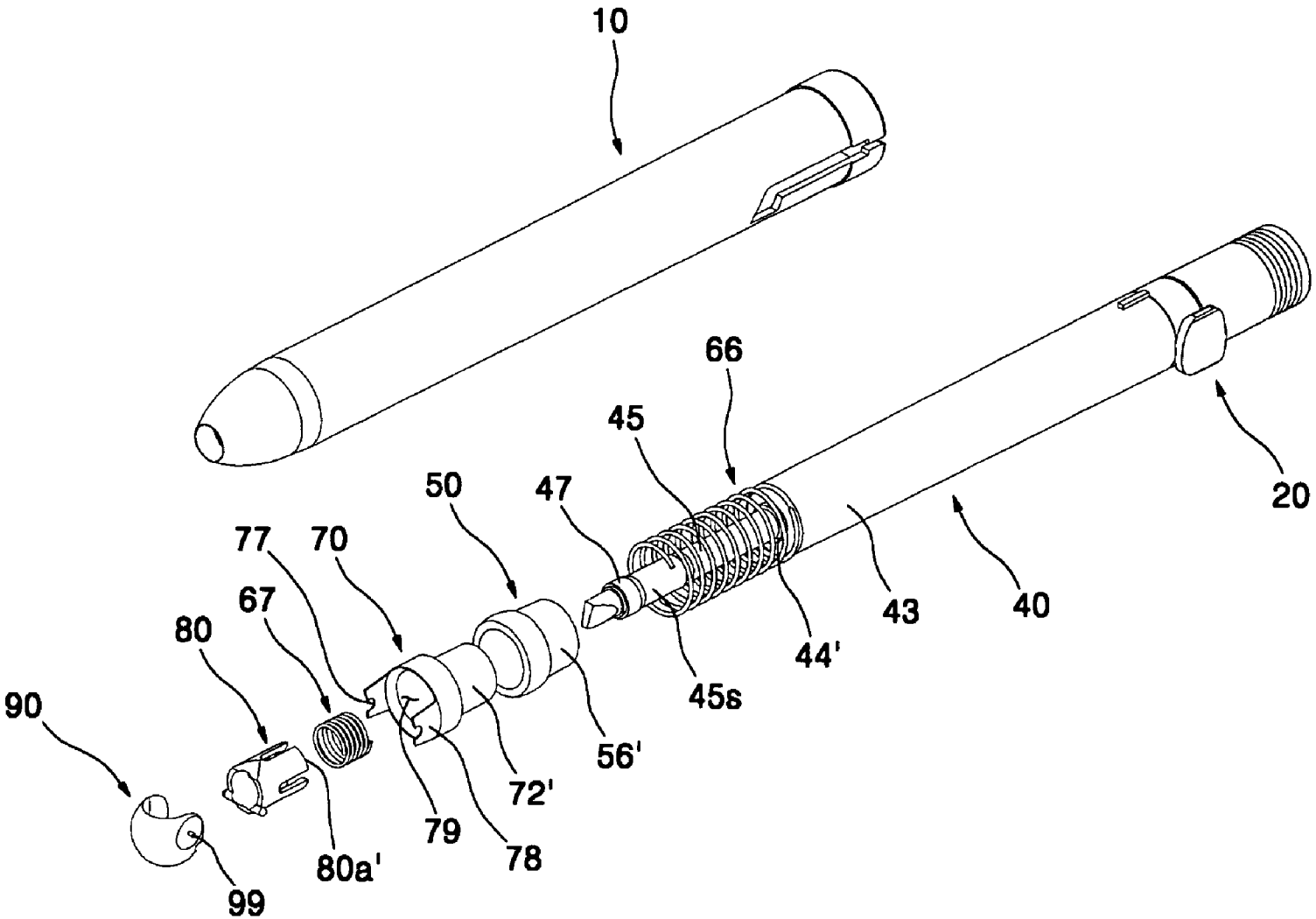
FIG. 19 is an exploded perspective view of a slide-type writing instrument with a dry prevention unit, according to a third embodiment of the present invention.
Figure 20A:
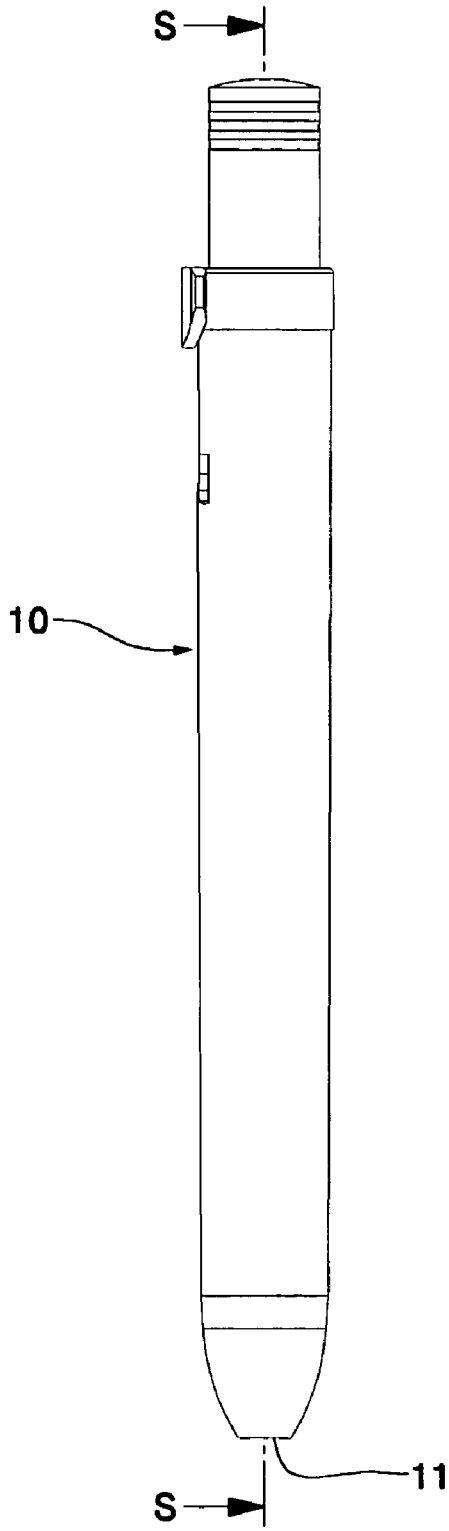
FIGS. 20*a* through 20*f* are views to illustrate assembly and operations of the writing instrument of FIG. 19, in which FIGS. 20*a,* 20*c,* and 20*e* are side views of the writing instrument.
Figure 20B:
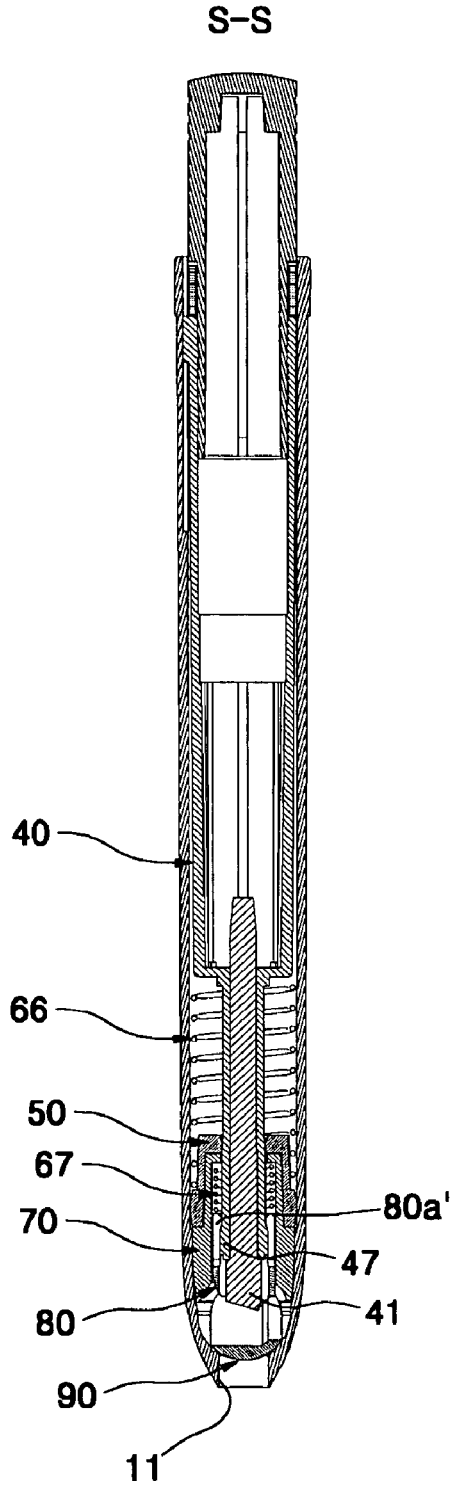
Figure 20C:
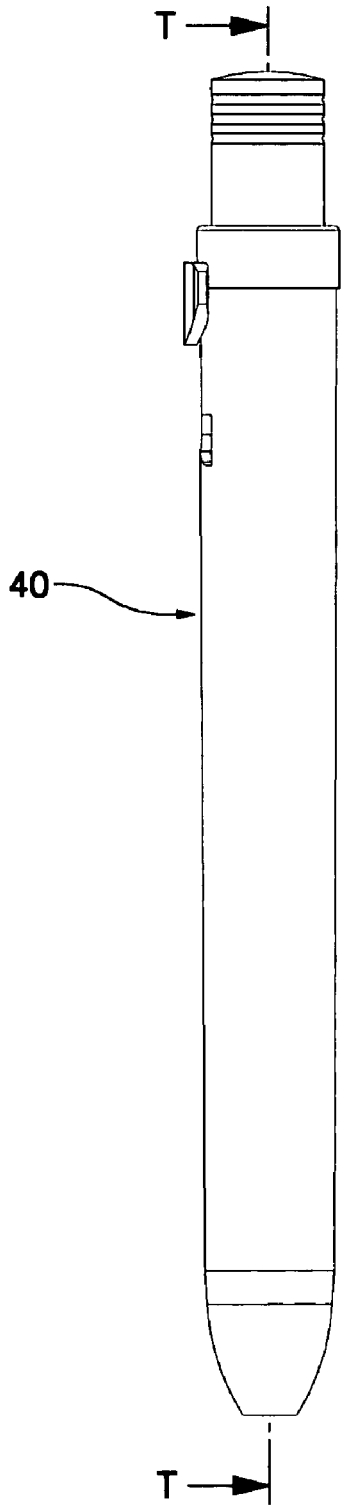
Figure 20D:
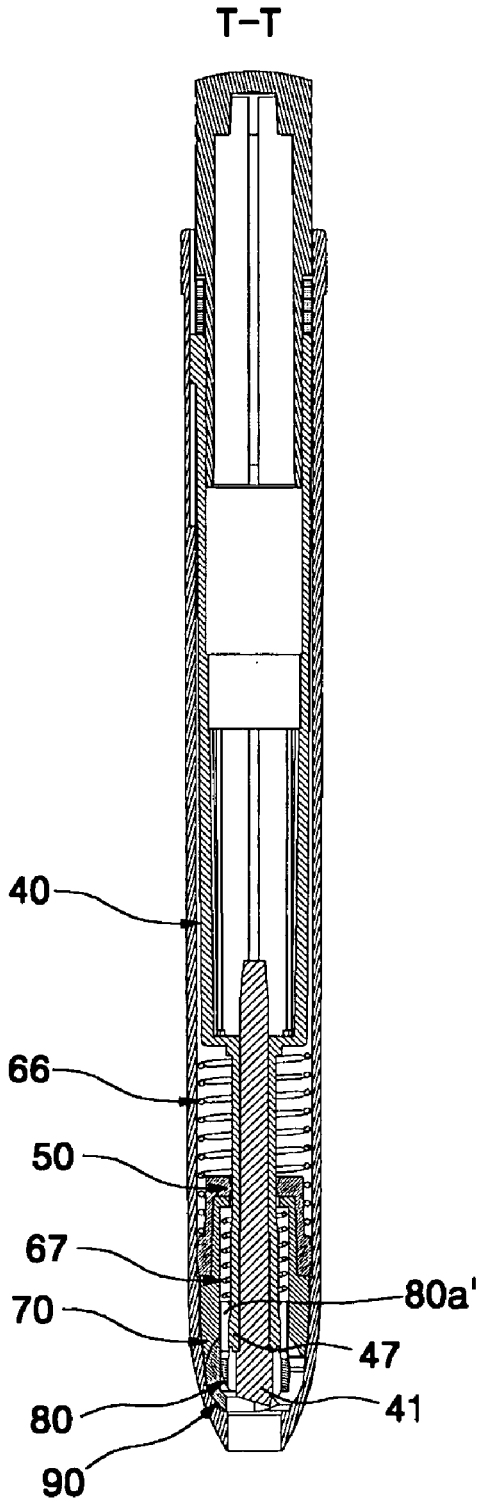
Figure 20E:
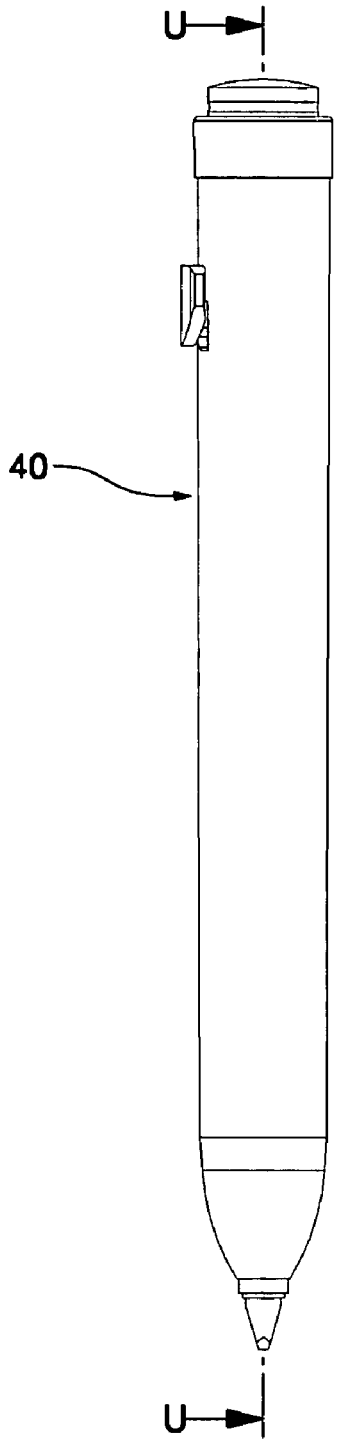
Figure 20F:
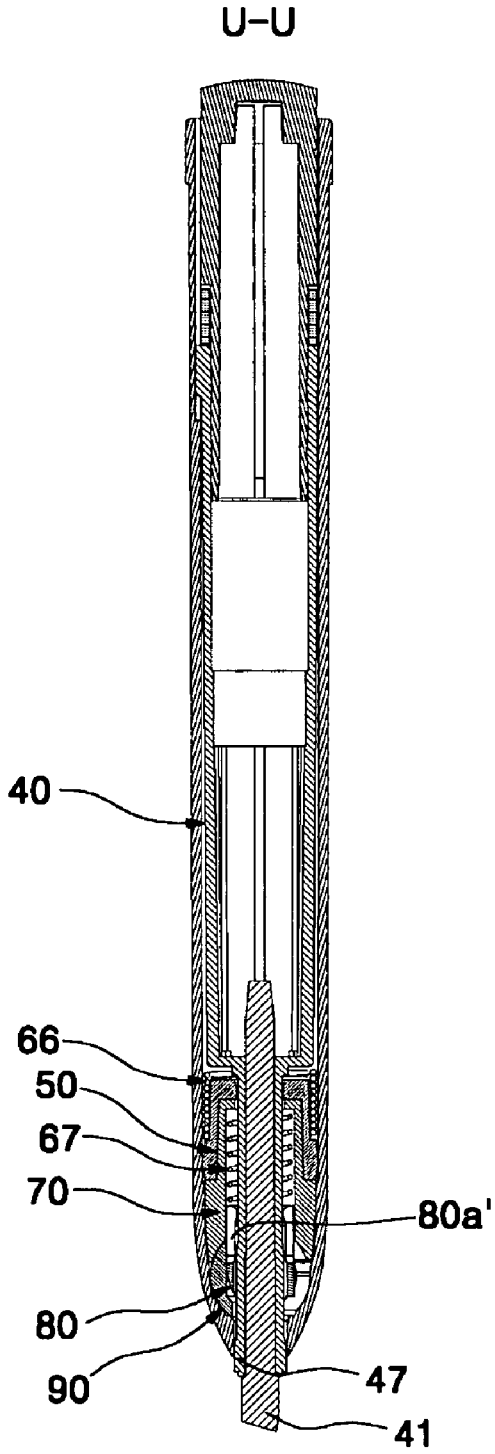

FIG. 19 is an exploded perspective view of the slide-type writing instrument with the dry prevention unit, according to a third embodiment of the present invention, and FIGS. 20*a* through 20*f* are views to illustrate assembly and operations of the writing instrument of FIG. 19, in which FIGS. 20*a*, 20*c*, and 20*e* are side views of the writing instrument, FIG. 20*b* is a sectional view taken along the line S—S of FIG. 20*a*, FIG. 20*d* is a sectional view taken along the line T—T of FIG. 20*c*, and FIG. 20*f* is a sectional view taken along the line U—U of FIG. 20*e*.

As shown in FIG. 19, in the writing instrument of the third embodiment, a switch 20 or a conventional cartridge control unit is installed between a knock part 30 and a cartridge 40. The writing instrument includes a first spring 66 which restores the cartridge 40 to an original position thereof using an elastic force of the first spring 66. An O-ring 50 is slidably installed in the shaft 10 to seal a gap between the cartridge 40 and the shaft 10. A link holder 70 is provided in the shaft 10 while an end of the link holder 70 is axially inserted into the O-ring 50. The writing instrument also includes a link 80 which is elastically supported in the link holder 70 by a second spring 67. The link 80 includes a plurality of elastic pieces 80*a*' engaging with a clutch part 47, so as to smoothly and rapidly slide. Further, a spherical door 90 is provided in the shaft 10, and rotates at a predetermined rotating angle, as a parallel pin 82 of the link 80 is coupled to pin slits 92 of the spherical door 90 and the link 80 slidably reciprocates.

The cartridge 40 has characteristics as follows. That is, an axial length of a coupling part 44' provided between a tank part 43 and a nib extension part 45 is relatively shorter, because the second spring 67 is installed in the shaft 10.

Further, a sliding circumferential part 45*s* is further provided on the nib extension part 45 of the cartridge 40. In this case, the sliding circumferential part 45*s* has a diameter which is smaller than a maximum diameter of the clutch part 47 but is larger than a diameter of the nib extension part 45.

The sliding circumferential part 45*s* is in contact with both a smaller-diameter hole of the O-ring 50 and a support step provided at an end of an inner circumference of a rear part 72' of the link holder 70, thus more efficiently sealing a gap between the cartridge 40 and the shaft 10, and minimizing a gap to the second spring 67, and minimizing an internal area for the second spring 67, and thereby enhancing operational performance and minimizing the amount of air which may enter the interior of the shaft 10, therefore minimizing the drying of ink.

The second spring 67 has a diameter which is sufficient to be inserted into a link mount hole 79 of the link holder 70. The second spring 67 is coupled to the link holder 70 to be supported by the support step, thus axially biasing the link 80.

In this case, a pair of rotary support brackets 78 are provided at opposite sides of a front portion of the link holder 70. Each of the rotary support brackets 78 has a seating depression 77 so that each hinge shaft 99 of the spherical door 90 is rotatably seated in the corresponding seating depression 77.

Such a construction minimizes frictional resistance between the spherical door 90 and the link holder 70, thus minimizing vibration or noise which may be generated due to the spherical door 90 and the link holder 70.

Further, an axial length of the rear part 72' of the link holder 70 is longer than the axial length of the rear part 72 of the first embodiment so that the link holder 70 receives the second spring 67 therein.

Similarly, the O-ring 50 fitted over the rear part 72' of the link holder 70, has a longer spring seat 65'.

Particularly, an axial length of a larger diameter hole of the O-ring 50 is similar or equal to an axial length of the rear part 72' of the link holder 70.

Further, the link 80 is provided with a plurality of elastic pieces 80*a*' having a simple circumferential surface, without the fitting steps 80*c* of the second embodiment.

The projection and retraction of the nib according to the third embodiment will be described in the following.

FIG. 20*a* is a side view of the writing instrument according to the third embodiment, and FIG. 20*b* is a sectional view taken along the line S—S of FIG. 20*a*. As shown in the drawings, when a user presses the knock part 30 with the user's finger, the cartridge 40 axially moves forward. At this time, the O-ring 50 and the cartridge 40 coupled to the knock part 30 keep closed.

FIG. 20*c* is a side view of the writing instrument according to the third embodiment, and FIG. 20*d* is a sectional view taken along the line T—T of FIG. 20*c*. FIGS. 20*c* and 20*d* show the state when the knock part 30 and the cartridge 40 move forward by a predetermined stroke distance, for example, 4 mm. At this time, the spherical door 90 rotates at a rotating angle of +90° in an opening direction, thus opening the nib hole 11 of the shaft 10.

At this time, the cartridge 40 and the link 80 are placed inside the passage of the spherical door 90, because the cartridge 40 is coupled to the link 80, in a similar manner to the engagement between the clutch part 47 and the elastic pieces 80*a* according to the first embodiment.

FIG. 20*e* is a side view of the writing instrument according to the third embodiment, and FIG. 20*f* is a sectional view taken along the line U—U of FIG. 20*e*. When the cartridge 40 and the knock part 30 further move forward by a predetermined stroke distance, for example, 12 mm and thereby move forward by a predetermined total stroke distance, for example, 16 mm, the nib 41 and a part of the clutch part 47 are projected out of the nib hole 11. When the switch 20 or the conventional cartridge control unit is locked in such a state, the user can write with the writing instrument. Meanwhile, the nib retracting operation is executed in reverse order to the nib projecting operation described above.

As described above, the present invention provides a slide-type writing instrument with a dry prevention unit, which is constructed so that a user needs not open or close a cap, thus being convenient to use, and which is constructed so that a nib hole of a shaft is opened or closed by a projection or retraction of a nib, thus preventing the drying of ink.

The slide-type writing instrument with the dry prevention unit is constructed so that an interior of the shaft storing the nib is sealed by a spherical door and an O-ring, thus prolonging a life span of ink, therefore maximizing product performance.

Further, the slide-type writing instrument with the dry prevention unit is constructed so that the spherical door is opened or closed in a direct transmission manner. Thus, a first spring and a link holder make the spherical door be in close contact with a rounded surface inside the nib hole, while controlling the operation of the spherical door, thus having excellent operational performance.

The slide-type writing instrument with the dry prevention unit is constructed to control an operation of the nib by holding the shaft corresponding to a body by one hand and manipulating a switch with the user's finger, thus being very convenient to use.

Further, the slide-type writing instrument with the dry prevention unit is constructed to remarkably reduce a space of the shaft for receiving the nib due to the coupling method between a clutch part of a nib extension part and elastic pieces of a link, thus reducing the amount of air entering the shaft during the operation of the spherical door, therefore more efficiently preventing ink of the nib from being dried up.

The slide-type writing instrument with the dry prevention unit is constructed to use a single spring or two springs. Regardless of using the single spring or two springs, the spherical door is rapidly opened or closed. Further, the nib is not in contact with the spherical door, so that it is possible to receive the nib in the shaft to be safely retracted into or projected out of the shaft.

Further, the slide-type writing instrument with the dry prevention unit is constructed so that no slit is formed on the nib extension part, thus enhancing a sealing effect using the O-ring.

Furthermore, the slide-type writing instrument with the dry prevention unit is constructed so that the O-ring is installed in the shaft while surrounding a part of the link holder, that is, the O-ring does not slide and the nib extension part of the cartridge slides while passing the O-ring, thus having more excellent sealing effect.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A slide-type writing instrument with a dry prevention unit, comprising:

a knock part to control a nib so that the nib is projected out of or retracted into a nib hole provided at an end of a shaft;

a cartridge inserted into the shaft while being coupled at opposite ends thereof to the knock part and the nib, respectively;

a spring provided in the shaft to elastically restore the cartridge to an original position thereof;

an O-ring provided in the shaft to be supported by the spring;

a link holder partially inserted into the O-ring;

a link slidably coupled to the link holder, and having a plurality of elastic pieces to engage with a clutch part of the cartridge within an elastic range of the elastic pieces; and a spherical door having a pin slit to engage with a parallel pin of the link.

2. The slide-type writing instrument according to claim 1, wherein the clutch part comprises:

a tapered surface provided at a position around a stepped portion of a nib extension part;

a clutch recess provided at a position around the tapered surface, and having a semi-circular cross-section; and a non-skid projection provided at a position around the clutch recess, and having a semi-circular cross-section.

3. The slide-type writing instrument according to claim 2, wherein each of the elastic pieces comprises an elastic projection to be seated in the clutch recess of the clutch part.

4. The slide-type writing instrument according to claim 1, wherein the link holder comprises a support step at an end of an inner circumference of a rear part of the link holder so that a fitting step of the link is stopped by the support step, thus limiting a sliding motion of the link.

* * * * *